US012774059B2

(12) United States Patent
Reimers

(10) Patent No.: US 12,774,059 B2
(45) Date of Patent: Oct. 27, 2026

(54) DEVICE FOR FLOATING A BOAT LINE

(71) Applicant: TRU-TOSS LLC, Waukee, IA (US)

(72) Inventor: Matthew Glenn Reimers, Waukee, IA (US)

(73) Assignee: TRU-TOSS LLC, Waukee, IA (US)

( * ) Notice: Subject to any disclaimer, the term of this patent is extended or adjusted under 35 U.S.C. 154(b) by 776 days.

(21) Appl. No.: 18/296,837

(22) Filed: Apr. 6, 2023

(65) Prior Publication Data

US 2023/0322331 A1 Oct. 12, 2023

Related U.S. Application Data

(60) Provisional application No. 63/362,709, filed on Apr. 8, 2022.

(51) Int. Cl.
*B63B 21/20* (2006.01)

(52) U.S. Cl.
CPC ..... *B63B 21/20* (2013.01)

(58) Field of Classification Search
CPC ..... B63B 21/20
See application file for complete search history.

(56) References Cited

U.S. PATENT DOCUMENTS

| | | | | |
|---|---|---|---|---|
| 589,224 | A | 8/1897 | Samuelson | |
| 3,294,053 | A | 12/1966 | Emery, Jr. | |
| 3,327,999 | A | 6/1967 | Mitchell | |
| 4,143,446 | A | 3/1979 | Down | |
| 5,412,902 | A * | 5/1995 | Hicks | A01K 93/00 43/44.87 |
| 5,660,133 | A | 8/1997 | Munich | |
| 6,418,592 | B1 | 7/2002 | Mohtasham | |
| 8,245,360 | B2 | 8/2012 | Stafford et al. | |
| 8,347,806 | B2 | 1/2013 | Griffin | |
| 9,265,240 | B2 * | 2/2016 | Kavanaugh | A01K 93/00 |
| 2013/0198999 | A1 | 8/2013 | Ferguson | |
| 2018/0058541 | A1 | 3/2018 | Brett | |

OTHER PUBLICATIONS

Floating Rescue Line, Jwin, Retrieved from the Internet <URL:https://www.aliexpress.us/item/2255801063675004.html?gatewayAdapt=glo2usa4itemAdapt&_randl_shipto=US>, 10 pages, retrieved Mar. 28, 2023.

Fox 40 Safety Rope + Float/Rope 50ft (m), Fox 40, Retrieved from the Internet <URL:https://www.whitworths.com.au/fox-40-safety-rope-float-rope-50ft-15m>, 2 pages, retrieved Mar. 28, 2023.

* cited by examiner

*Primary Examiner* — Anthony D Wiest
(74) *Attorney, Agent, or Firm* — McKee, Voorhees & Sease, PLC

(57) ABSTRACT

A flotation device comprises a head having a lower, partially annular surface and a rectangular slot located at the front of the head. A body of the device comprises an upper partially annular surface proximate the lower partially annular surface, tapered fingers located at an end of the body opposite the upper partially annular surface, and angled channels on an inner surface of the body. An inner casing connects the rotatable head and the body. A boat line or dock line, such as a rope, can be placed into a central aperture that also serves as a central aperture for the head and the body. A helical ridge located on an outer, circumferential surface of the body can be rotated within the channel of the body until the channel terminates.

20 Claims, 28 Drawing Sheets

DEVICE FOR FLOATING A BOAT LINE

CROSS REFERENCE TO RELATED APPLICATIONS

This application claims priority under 35 U.S.C. § 119 to provisional patent application U.S. Ser. No. 63/362,709, filed Apr. 8, 2022. The provisional patent application is herein incorporated by reference in its entirety, including without limitation, the specification, claims, and abstract, as well as any figures, tables, appendices, or drawings thereof.

FIELD OF THE INVENTION

The present invention relates generally to a flotation device and/or systems having applications in at least the marine and recreational industries. More particularly, but not exclusively, the present invention relates to a mechanism that rotatably secures to boat and/or dock lines whilst keeping same above water.

BACKGROUND OF THE INVENTION

The background description provided herein gives context for the present disclosure. Work of the presently named inventors, as well as aspects of the description that may not otherwise qualify as prior art at the time of filing, are neither expressly nor impliedly admitted as prior art.

Use of rope gripping devices have been employed in marine vehicles. For example, U.S. Pat. No. 8,245,360 to Stafford et al. discloses a rope gripping device having a male end cap and a female end cap. One of the male or female end caps is rotated against the other, which performs a locking function by rotation. However, the device of Stafford et al. fails to keep a boat line above the water surface.

At best, those in the art have tried solving these issues by making the line out of a buoyant material. However, these lines can be expensive. Moreover, if made from a buoyant material, the line loses the ability to be used effectively both above and below water.

Anchor raising apparatuses, such as those described in U.S. Pat. No. 8,347,806 have been employed to help raise anchor lines. Such devices have buoyant members for retrieving the anchor line from the water. However, these devices are limited in their application, and do not disclose a rotatable gripping mechanism(s) for enhancing grip of boat lines.

Thus, there exists a need in the art for a device and/or apparatus which allows non-buoyant boat/dock lines to float.

SUMMARY OF THE INVENTION

The following objects, features, advantages, aspects, and/or embodiments, are not exhaustive and do not limit the overall disclosure. No single embodiment need provide each and every object, feature, or advantage. Any of the objects, features, advantages, aspects, and/or embodiments disclosed herein can be integrated with one another, either in full or in part.

It is a primary object, feature, and/or advantage of the present invention to improve on or overcome the deficiencies in the art.

It is a further object, feature, and/or advantage of the present invention to float boat/dock lines and/or enhance grip of boat/dock lines.

It is still yet a further object, feature, and/or advantage of the present invention to employ coverings that protect boat/dock lines while keeping same above water.

It is still yet a further object, feature, and/or advantage of the present invention to provide a buoyant weight at the end of a boat and/or dock line to enhance the distance in which a boat/dock line can be thrown, without losing said line in the sea. Moreover, the weight can also allow the boat rope to be thrown with greater accuracy.

It is still yet a further object, feature, and/or advantage of the present invention to provide a flotation device made of a soft material such that if the device were to contact anyone or anything while being thrown, any harm and/or damage would be eliminated and/or minimized.

The flotation device disclosed herein can be used in a wide variety of applications. For example, the flotation device can be used for both static (e.g., the flotation device is not intended to move) and dynamic (e.g., the flotation device is intended to move) applications.

It is preferred the apparatus be safe, cost effective, and durable. For example, the outer surfaces of the flotation device should be free from sharp edges and can be made of a soft material so as not to damage users' hands handling the device. The apparatus can be also adapted to resist excessive heat, static buildup, corrosion, and/or mechanical failures (e.g. cracking, crumbling, shearing, creeping) due to excessive impacts and/or prolonged exposure to tensile and/or compressive acting on the apparatus.

At least one embodiment disclosed herein comprises a distinct aesthetic appearance. Ornamental aspects included in such an embodiment can help capture a consumer's attention and/or identify a source of origin of a product being sold. Said ornamental aspects will not impede functionality of the present invention.

Methods can be practiced which facilitate use, manufacture, assembly, maintenance, and repair of the flotation device which accomplish some or all of the previously stated objectives.

The flotation device can be incorporated into systems or kits (e.g. including those with the boat/dock lines) which accomplish some or all of the previously stated objectives.

According to some aspects of the present disclosure, a flotation device comprises a head comprising: a lower, partially annular surface; and a rectangular slot located at a front of the head; a body comprising: an upper partially annular surface proximate the lower partially annular surface; tapered fingers located at an end of the body opposite the upper partially annular surface; and angled channels on an inner surface of the body; an inner casing connecting the rotatable head and the body, said inner casing comprising; a central aperture that also serves as a central aperture for the head and the body; a helical ridge located on an outer, circumferential surface of the body; wherein the head is rotatable with respect to the body.

According to at least some aspects of some embodiments disclosed, the inner casing is a cylindrically shaped rotor.

According to at least some aspects of some embodiments disclosed, the head rotates with respect to the inner casing and the inner casing is rotatably fixed in relation to the head.

According to at least some aspects of some embodiments disclosed, the head is slidably connected to the inner casing.

According to at least some aspects of some embodiments disclosed, the flotation device further comprises a push-and-twist lock.

According to at least some aspects of some embodiments disclosed, the head is fixed to the inner casing.

According to at least some aspects of some embodiments disclosed, the body rotates with respect to the inner casing and the head is fixed to the inner casing.

According to at least some aspects of some embodiments disclosed, the body is buoyant.

According to at least some aspects of some embodiments disclosed, the head is buoyant.

According to at least some aspects of some embodiments disclosed, the head further comprises an inner, textured circumferential surface.

According to at least some aspects of some embodiments disclosed, the flotation device further comprises lubricant within said angled channels.

According to at least some aspects of some embodiments disclosed, a flotation device comprises a generally cylindrical body; a slot that extends through at least a portion of the body wherein the slot comprises: an outer portion; an inner portion; and a center portion.

According to at least some aspects of some embodiments disclosed, the center portion of the slot is located generally at or near the center of the cylindrical body, the outer portion of the slot is located generally at or near an outer edge of the cylindrical body, and the inner portion of the slot connects the outer and center portions of the slot.

According to at least some aspects of some embodiments disclosed, the flotation device further comprises a plurality of handles, wherein each of the plurality of handles is configured to fit a hand of a user.

According to at least some aspects of some embodiments disclosed, a flotation device comprises a body; a head member comprising a tower, wherein the tower is positioned at least partially within the body; a slot extending through at least a portion of the device, the slot comprising a body portion and a head member portion.

According to at least some aspects of some embodiments disclosed, the flotation device further comprises a connecting member wherein the connecting member facilitates connection between the body and the head member.

According to at least some aspects of some embodiments disclosed, the slot further comprises a connecting member portion.

According to at least some aspects of some embodiments disclosed, the body and/or connecting member comprise grooves.

According to at least some aspects of some embodiments disclosed, the tower comprises a plurality of tower protrusions and a helical member.

According to at least some aspects of some embodiments disclosed, the head member further comprises a plurality of surrounding protrusions.

These and/or other objects, features, advantages, aspects, and/or embodiments will become apparent to those skilled in the art after reviewing the following brief and detailed descriptions of the drawings. Furthermore, the present disclosure encompasses aspects and/or embodiments not expressly disclosed but which can be understood from a reading of the present disclosure, including at least: (a) combinations of disclosed aspects and/or embodiments and/or (b) reasonable modifications not shown or described.

BRIEF DESCRIPTION OF THE DRAWINGS

Several embodiments in which the present invention can be practiced are illustrated and described in detail, wherein like reference characters represent like components throughout the several views. The drawings are presented for exemplary purposes and may not be to scale unless otherwise indicated.

An artisan of ordinary skill in the art need not view, within isolated figure(s), the near infinite number of distinct permutations of features described in the following detailed description to facilitate an understanding of the present invention.

DETAILED DESCRIPTION OF THE INVENTION

The present disclosure is not to be limited to that described herein. Mechanical, electrical, chemical, procedural, and/or other changes can be made without departing from the spirit and scope of the present invention. No features shown or described are essential to permit basic operation of the present invention unless otherwise indicated.

Figure 1:
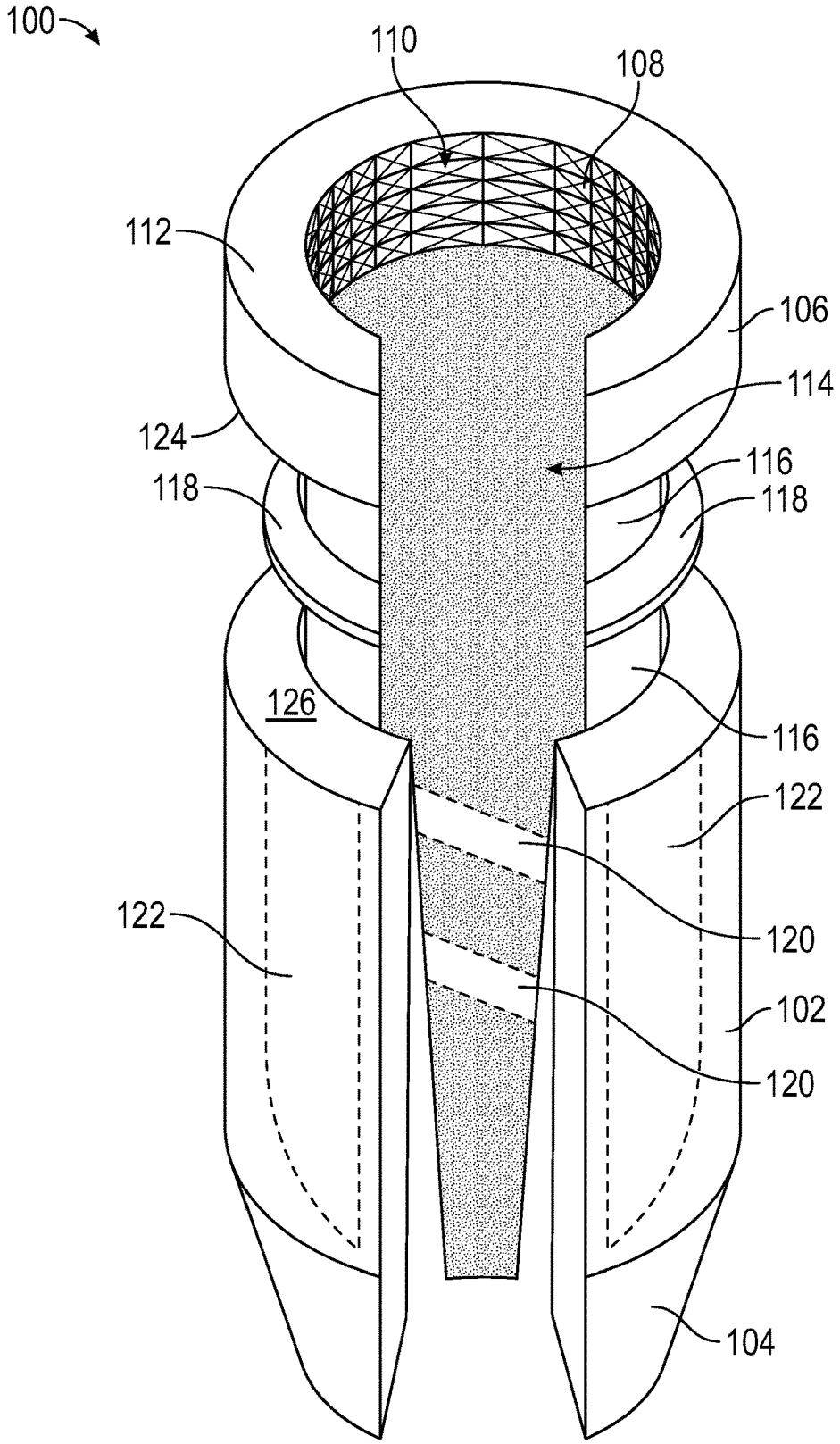
FIG. 1 shows a front perspective view wherein slots of the flotation device align allowing a rope to be inserted therethrough, according to some aspects of the disclosure.
Figure 2:
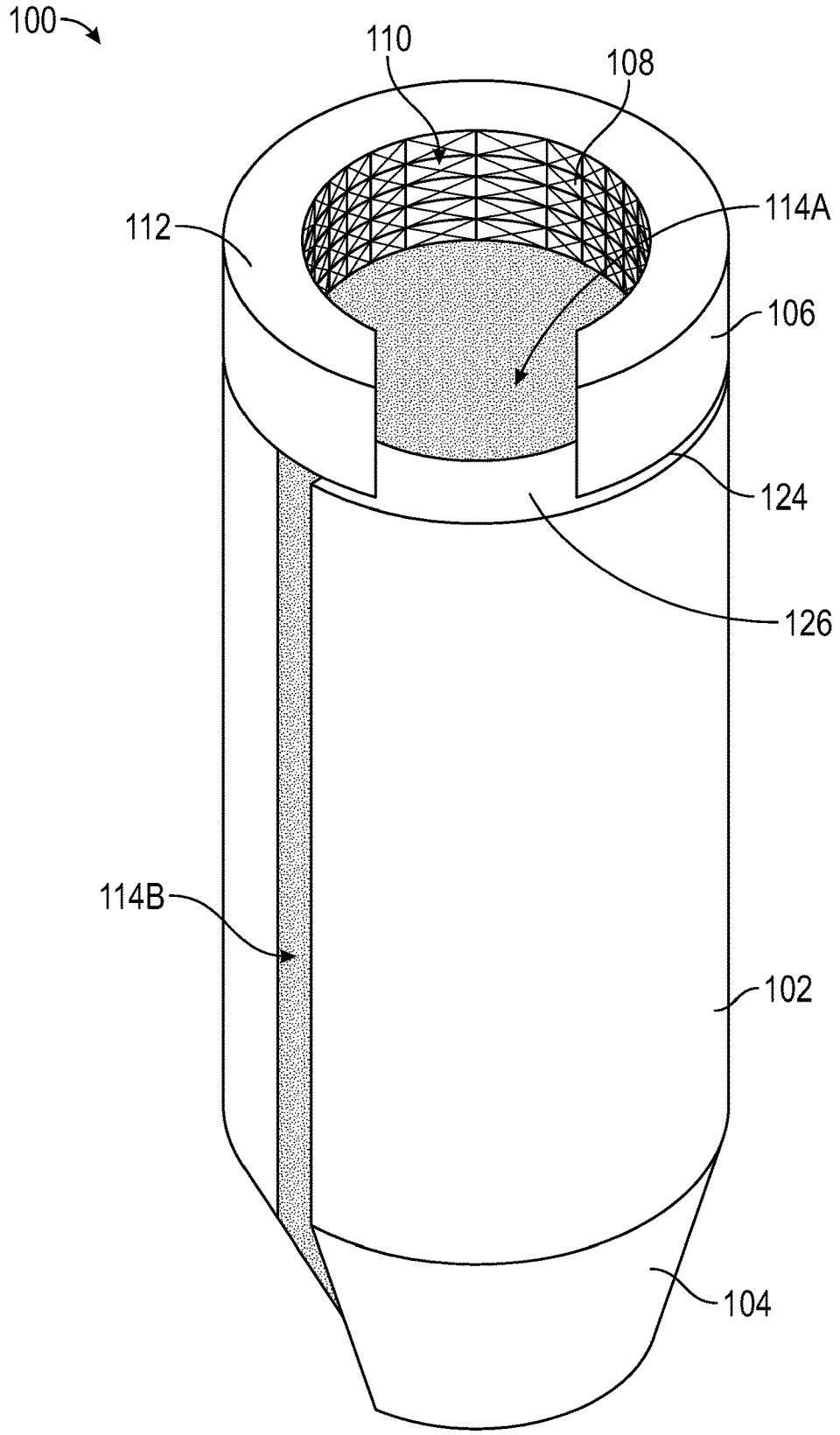
FIG. 2 shows a front preservative view of the flotation device of FIG. 1, wherein the slots no longer align, allowing the tapered fingers toward the bottom of the device to close.

Referring to FIGS. 1 and 2, the body 102 and/or fingers 122 can include a taper 104 at a distal end away from the head 106. The body itself can include the fingers 122 or the fingers 122 can be separate members from the body 102. The body 102 can comprise a soft material, such that when the body 102 is thrown, damage to external objects is minimized. The body can include upper annular surface 126.

The head 106 is generally of an annular shape and therefore includes annular surfaces 112 (upper), 124 (lower). The head can therefore also include an inner, partially circumferential surface 108 and an outer, partially circumferential surface.

The inner, circumferential surface 108 can be textured to enhance grip of a line. The inner surface 108 of head 106 can, for example, include knurling, protrusions, specially shaped grooves, partially adhesive substances, other materials or objects which provide a tactile effect, other known gripping materials, or any combination thereof.

The central aperture 110 runs through each component of the device 100 such that a line can be placed therein. A slot 114 toward the front of the head 106 and body 102 provides access to said central aperture 110. When the head 106 is rotated with respect to the body 102, the slot can be moved from an aligned position (FIG. 1) to an unaligned position (FIG. 2) and vice versa. In the unaligned position, the slot 114 is divided into two subsections 114A (head) & 114B (body).

The inner casing 116 is generally cylindrical and includes a helical ridge 118 protruding therefrom. The inner casing 116 can be used in a manner similar to the shank of an interior knob of a push-and-twist doorknob. For example, the inner casing 116 can be fixed to the head 106. The head 106 can then be twisted so as to drive the helical ridge 118 into the angled channels 120 of the body 102. Alternatively, the inner casing 116 can be fixed in relation to the body 102.

When in the secured position shown in FIG. 2, the lower annular surface 124 of the head 106 can contact the upper annular surface 126 of the body 102. In said embodiments, said surfaces can be further configured to completely overlap.

The channels 120 of the body 102 can include some tolerance ("give") when receiving the helical ridge 118. The channels 120 are uniform in thickness throughout or can be tapered. Likewise, the helical ridge 118 can be uniform in thickness throughout or tapered, similar to threads of a screw.

In some embodiments, the fingers 122 can retract inward as the head 106 is rotated with respect to the body 102. Further, the angle of the taper 104 can increase as the fingers 122 are retracted until the bottom edge of the taper 104 contacts the line.

Boat and/or dock lines can comprise, but are not limited to: nylon; polypropylene (plastic); braided/woven metals; cords; rope; plies; other fibrous materials, including synthetics; polyester; and/or cotton strands; and/or any other suitable materials. The lines themselves can be twisted or braided together into a larger and stronger form. Boat and/or dock lines must maintain tensile strength such that the boat lines can be used for dragging and lifting. Rope is thicker and stronger than similarly constructed cord, string, and twine, however rope is known to swell and most ropes sink in water.

In some embodiments, gaskets can be included between at least some portion of the body 102, head 106, and/or inner casing 116 to prevent wear and tear on the flotation device 100. Lubricants such as oil can also be used for surfaces that are slidably attached to help prevent wear and tear.

In some embodiments, the flotation device 100 can be adapted to help attach and secure the end of a dock/boat line to the dock, the boat, or other equipment.

The flotation device 100 can, in some embodiments, provide strain-relief and connect dock lines for which it is designed. In such situations, the flotation device 100 can even be used for sealing dock lines passing through bulkheads or gland plates.

FIGS. 3-11 show an embodiment of a flotation device 200 that includes a body 202, wherein the body comprises two sloped portions 204 and two ends 206. The sloped portions 204 can connect the body 202 to each end 206. The body 202 is generally cylindrical wherein each extremity of the body 202 includes a sloped portion 204 that each culminate at a generally flat end 206. While this embodiment of the flotation device 200 is cylindrical, the flotation device 200 could take any suitable shape according to other embodiments.

Figure 3:
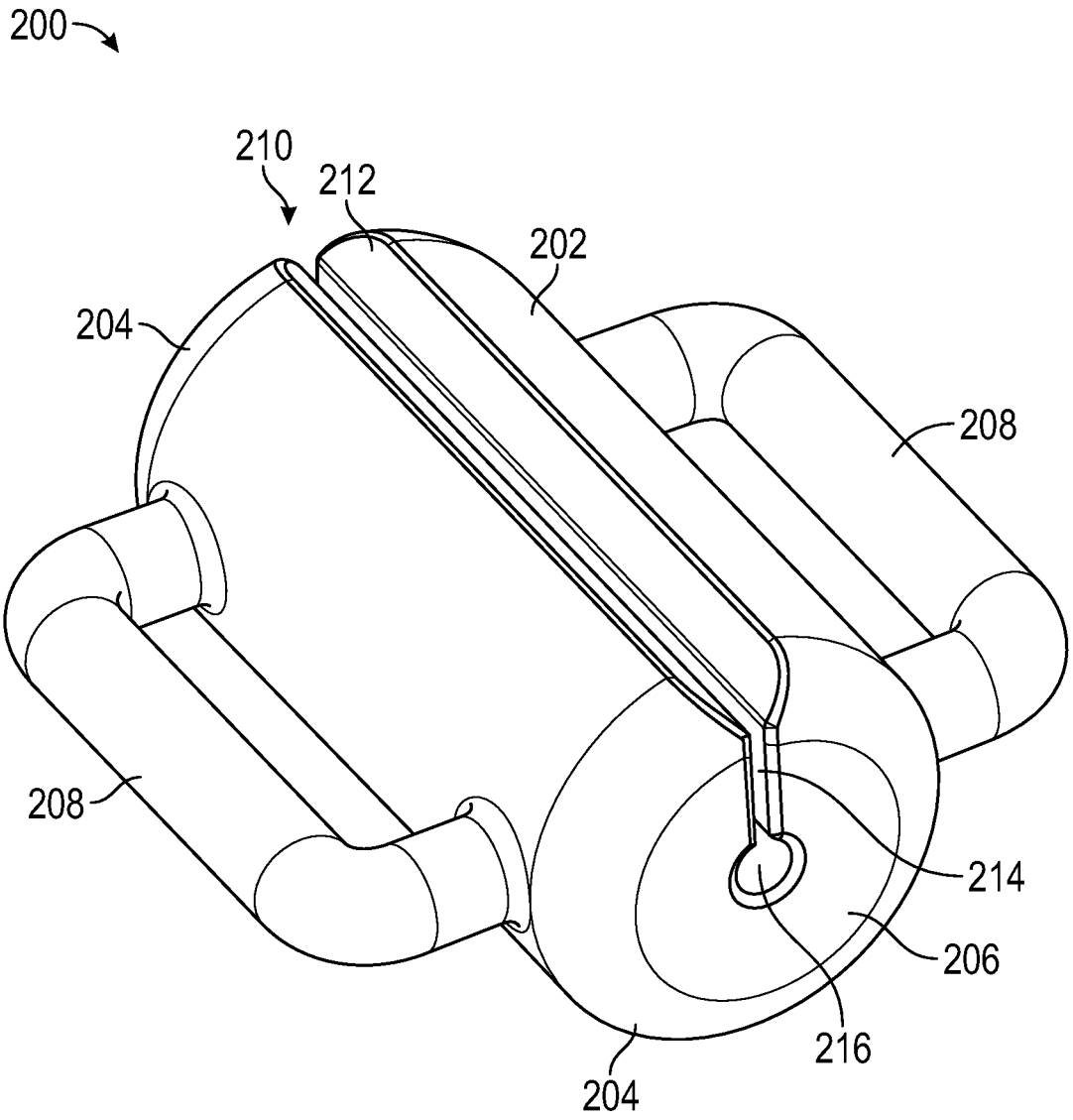
FIG. 3 shows a front perspective view of a flotation device.
Figure 4:
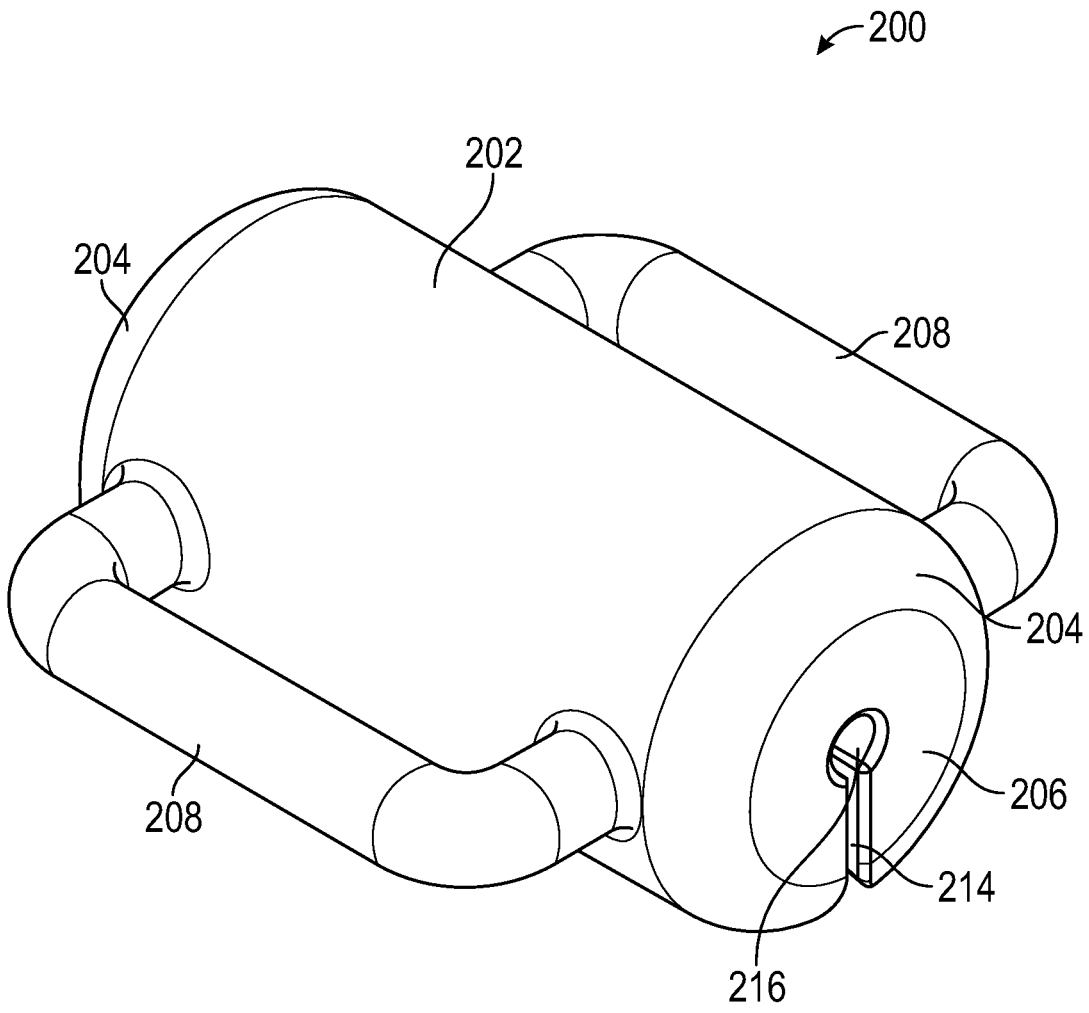
FIG. 4 shows a rear perspective view of the flotation device of FIG. 3.
Figure 5:
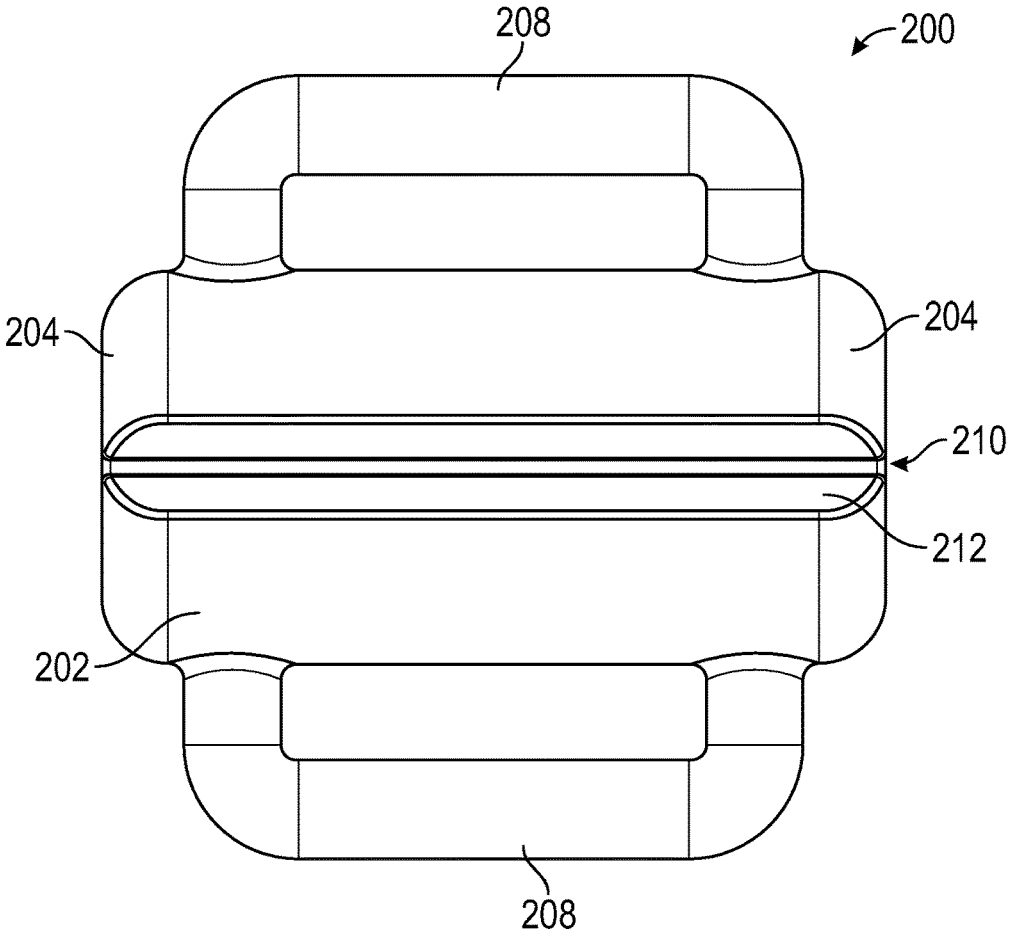
FIG. 5 shows a front elevation view of the flotation device of FIGS. 3 and 4.
Figure 6:
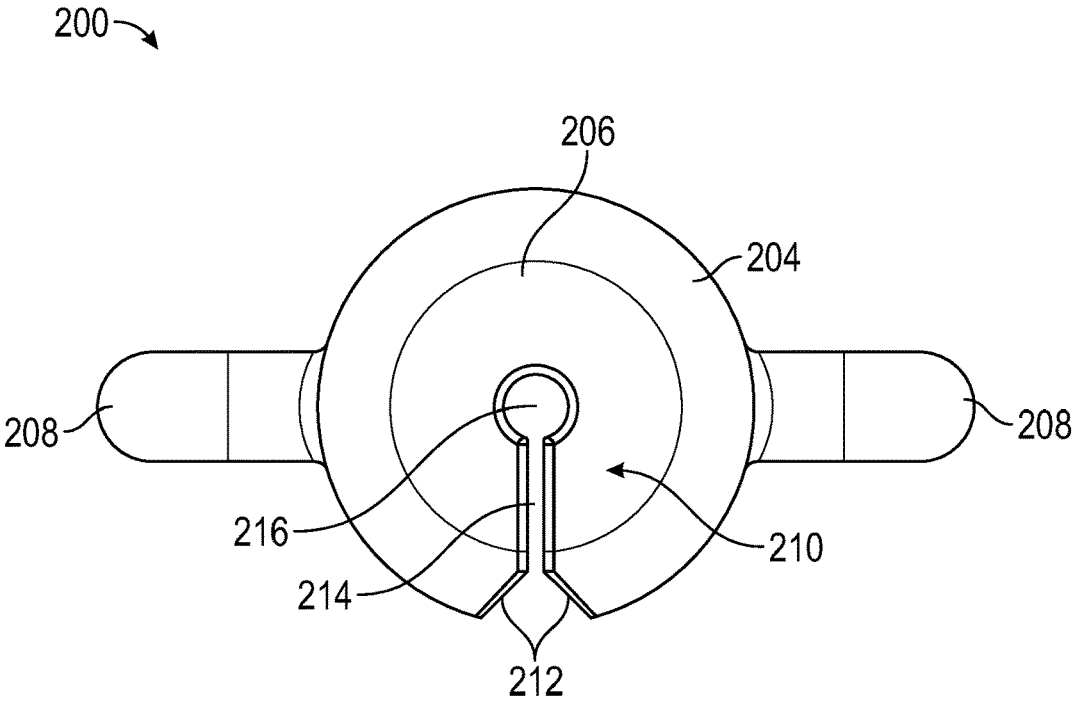
FIG. 6 shows a top elevation view of the flotation device of FIGS. 3-5
Figure 7:
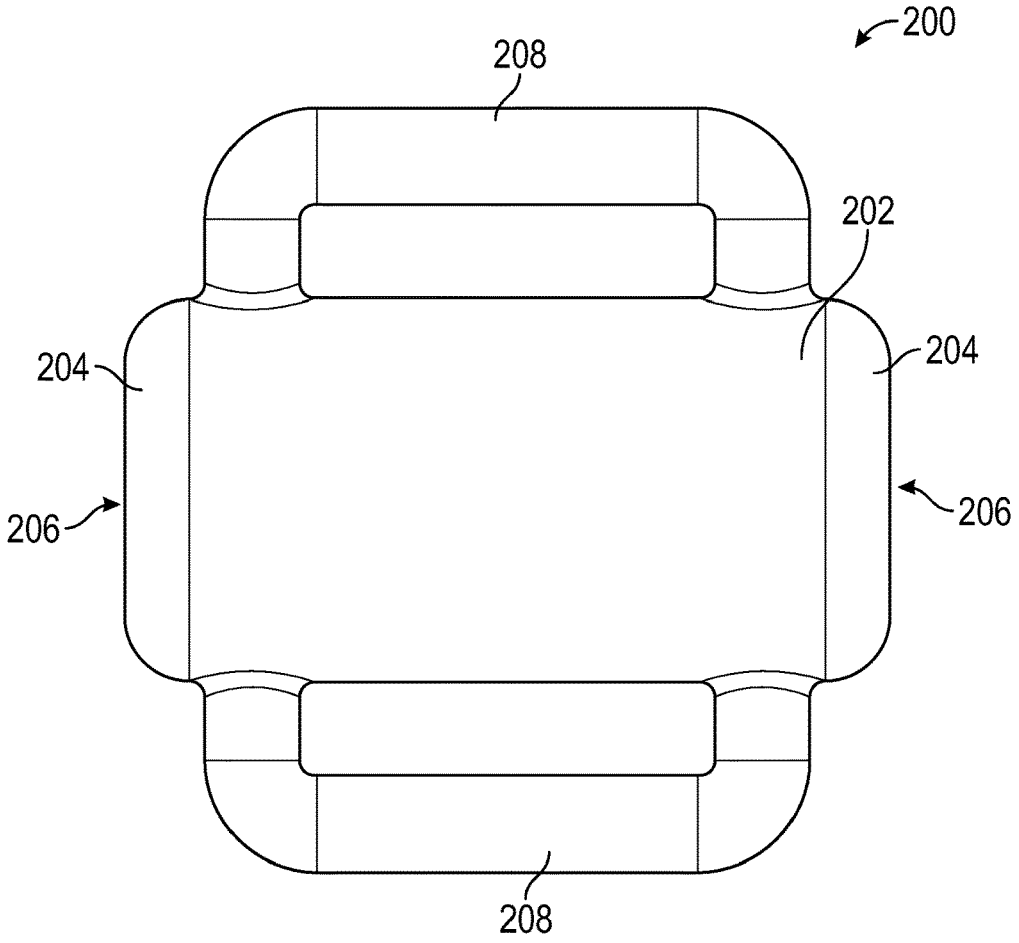
FIG. 7 shows a rear elevation view of the flotation device of FIGS. 3-6.
Figure 8:
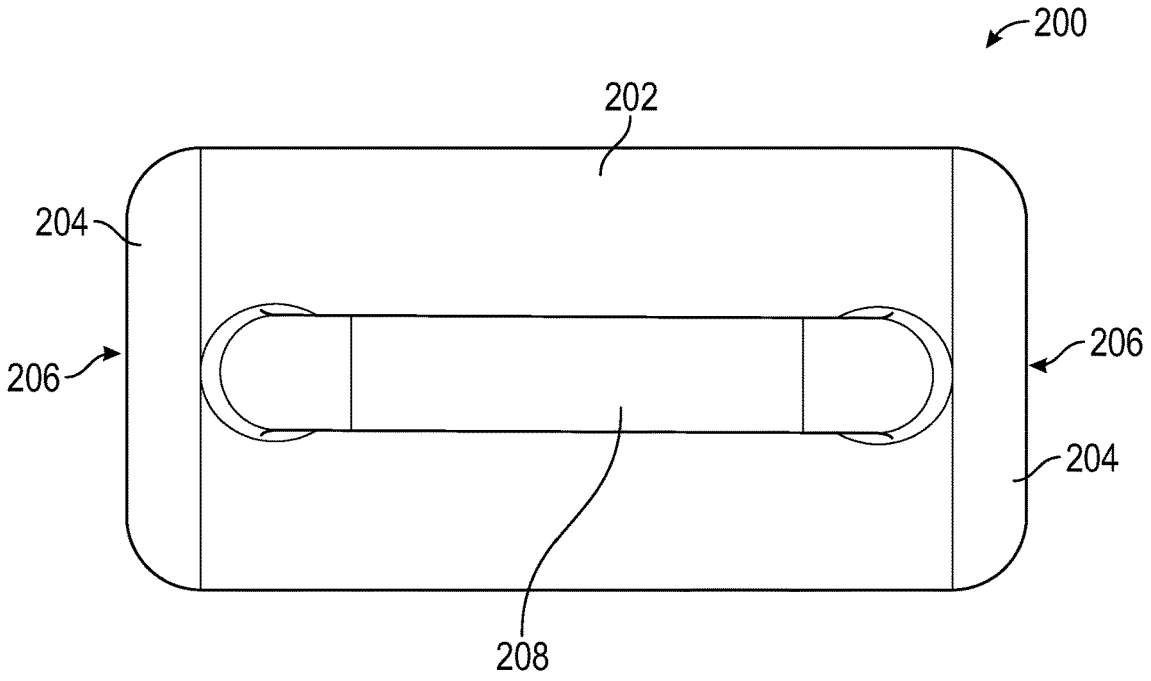
FIG. 8 shows a side elevation view of the flotation device of FIGS. 3-7.

As shown in FIG. 3, the flotation device 200 can include a slot 210 wherein there is a gap in a portion of the device 200 such that the center of the device 200 is exposed. The slot 210 can comprise an outer portion 212, an inner portion 214 and a center portion 216. The outer portion 212 can be sloped in that it can include two sloped faces that are slanted such that they create a wider gap toward the outer edge of the device 200 and narrow as the faces extend inward. In this way, the outer portion 212 of the slot 210 can be shaped generally as a "V" wherein the point of the "V" points to the center of the device 200. This shape of the outer portion 212 of the slot 210 allows for a line, rope, or other object, to easily enter the slot 210 via the outer portion 212 wherein the line, rope, or other object, is directed inward toward the inner portion 214 of the slot 210 and then toward the center portion 216 of the slot 210. While the outer portion 212 of the embodiment of FIGS. 3-11 has a "V" shape, any suitable shape could be used for the outer portion 212.

The inner portion 214 of the slot 210 comprises two opposing faces and is generally straight. However, according to some embodiments, the inner portion 214 can be of any suitable shape. The inner portion 214 is operatively connected to the outer portion 212 toward the outer edge of the device 200 and is operatively connected to the center portion 216 of the slot 210 toward the center of the device 200. The inner portion 214 facilitates movement of a line, rope, or other object, from the outer portion 212 to the center portion 216 and/or from the center portion 216 to the outer portion 212.

The center portion 216 of the slot 210 is generally circular in shape in the embodiment of FIGS. 3-11. However, according to some embodiments, the center portion 216 can be of any suitable shape. The center portion 216 is operably connected to the inner portion 214 to receive a line, rope, or other object, from the inner portion 214. The center portion 216 is configured to secure and/or hold in place a line, rope, or other object, once it is received from the inner portion 214. Thus, a line, rope, or other object can enter the outer portion 212, move to the inner portion 214, and then move to the center portion 216 where it is secured and/or held in place.

The embodiment of FIGS. 3-11 also includes two handles 208 connected to the body 202 of the device 200. While the embodiment of FIGS. 3-11 comprises two handles 208, any number of handles ranging from zero to N could be included wherein N is any number greater than zero. The handles 208 can be attached to the body 202 via molding or any other suitable means for attachment. The handles 208 can be configured so as to be easily grabbed/held by a hand of a user such that a user can easily throw, position, place, and/or retrieve the device 200. Additionally, the handles 208 allow for the device 200 to be easily retrieved via tools such as a hook, claw, handle, broom, pole, and the like. Additionally, the handles 208 provide for flotational stability in that the handles 208 can serve to keep the flotation device 200 stable while floating in water or other liquid.

Figure 9:
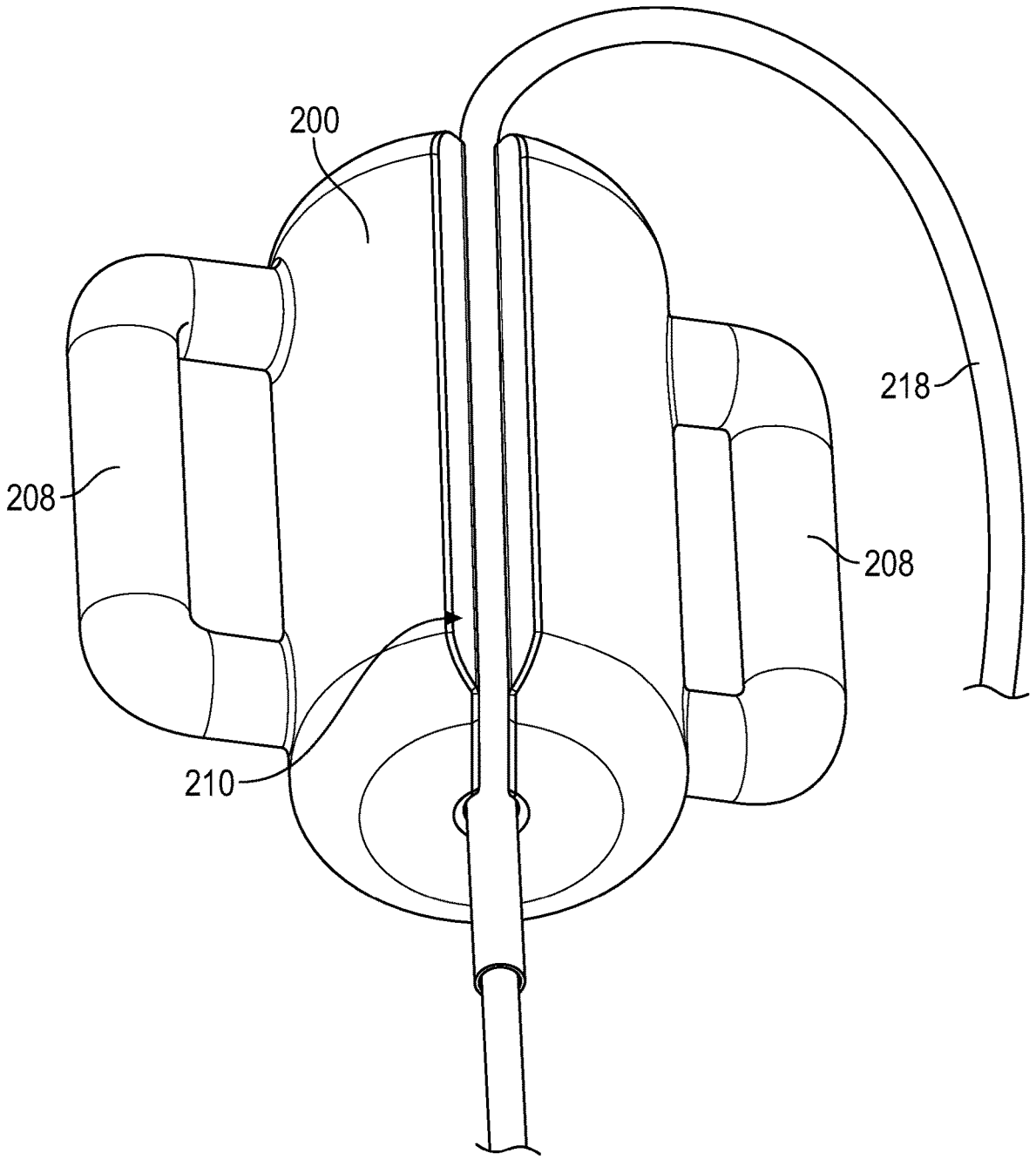
FIG. 9 shows a front perspective view of the flotation device of FIGS. 3-8 with a rope inserted in a slot.
Figure 10:
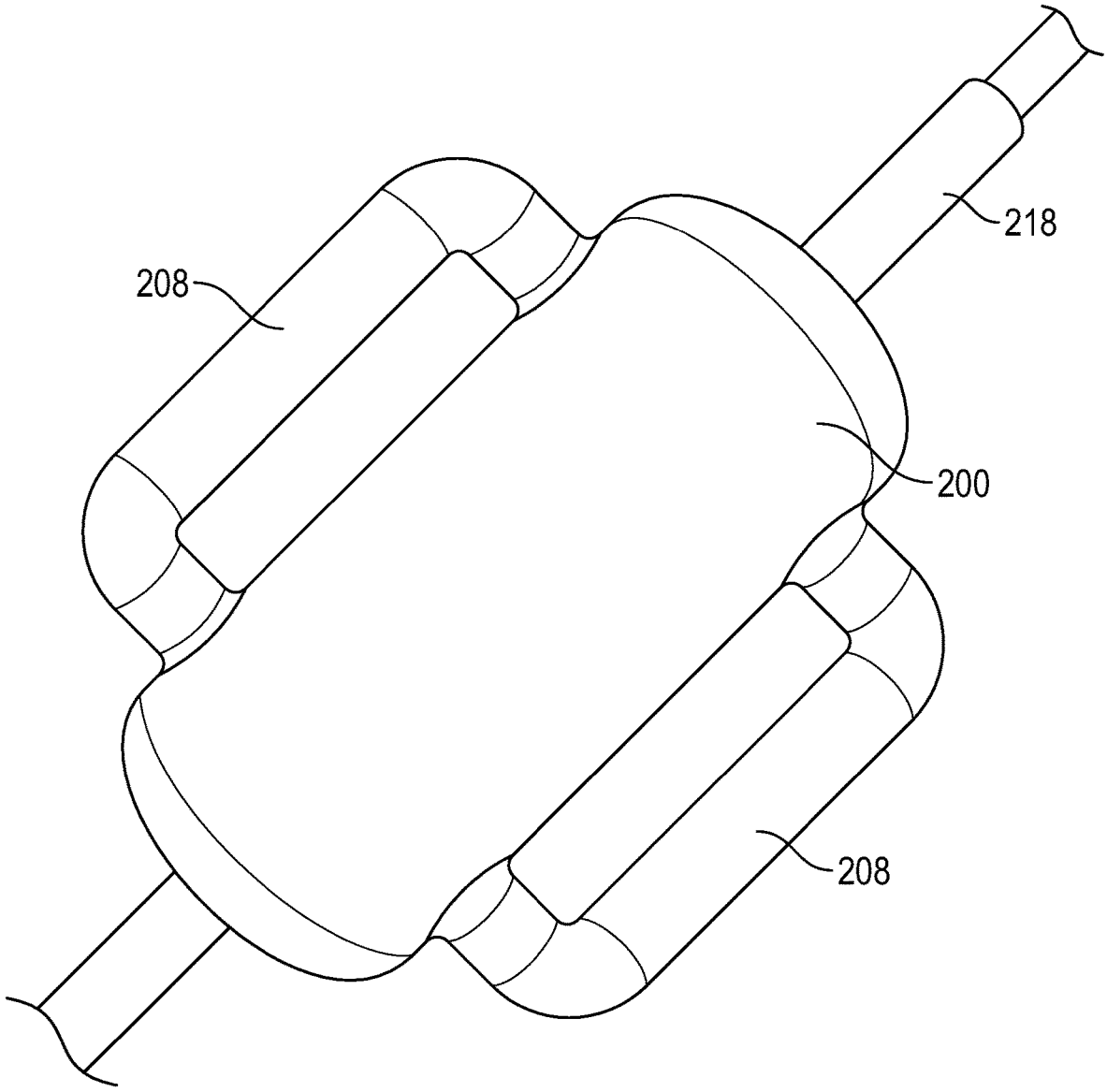
FIG. 10 shows a rear elevation view of the flotation device of FIGS. 3-9 that includes the rope inserted in the slot.

FIG. 9 shows the device 200 with a line/rope 218 inserted into the device 200. FIG. 10 shows a rear view of the device 200 with the line/rope 218 inserted into the device 200. The line/rope 218 can be inserted into the slot 210 by first entering the outer portion 212 of the slot, moving to the inner portion 214 of the slot, and then moving to the center portion 216 of the slot. According to some embodiments, an end of the line/rope 218 could directly enter the center portion 216 of the slot 210. The line/rope 218 can be secured, anchored, and/or held in place in the center portion 216 of the slot 218. The center portion 216 of the slot 218 can be configured to compress and/or apply pressure to the rope/line 218 once inserted into the center 216 such that the line/rope is secured, anchored, and/or held in place once inserted into the center portion 216 of the slot 210. Thus, when the device 200 is thrown, or otherwise used as a projectile, while the line/rope 218 is secured in the center portion 216 of the slot 210, the line/rope 218 will remain secured in the center portion 216 of the slot 210. A user can pull and/or otherwise apply force to the line/rope 218 to remove it from the device 200. The line/rope 218 can be any sort of line, rope, cable, and the like. According to some embodiments, the line/rope 218 can be boat and/or dock line.

Figure 11:
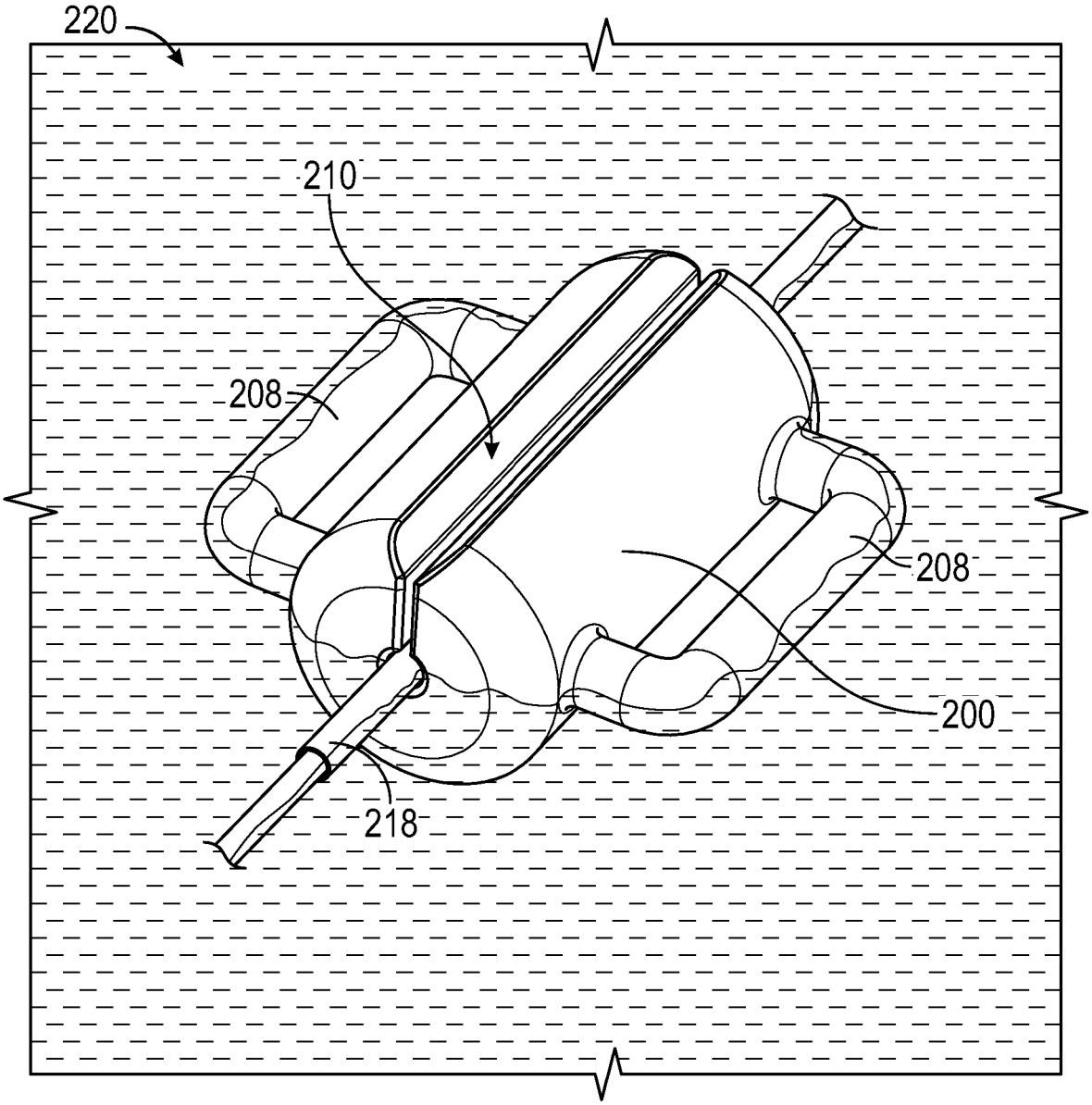
FIG. 11 shows a front perspective view of the flotation device of FIGS. 3-10 with the rope inserted in the slot, wherein the flotation device is floating in water.

FIG. 11 shows the device 200 with a line/rope 218 inserted into the device 200, and secured and/or held in place in the center portion 216 of the slot 210, wherein the device 200 is floating in water 220. As shown in FIG. 11, the device can keep the line/rope 218 out of and/or floating on top of the water 220. Thus, the line/rope 218 can be easily found and/or retrieved. The device 200 is capable of being used in any type and/or body of water including, but not limited to, a pool, pond, stream, river, lake, sea, ocean, and the like.

Figure 12:
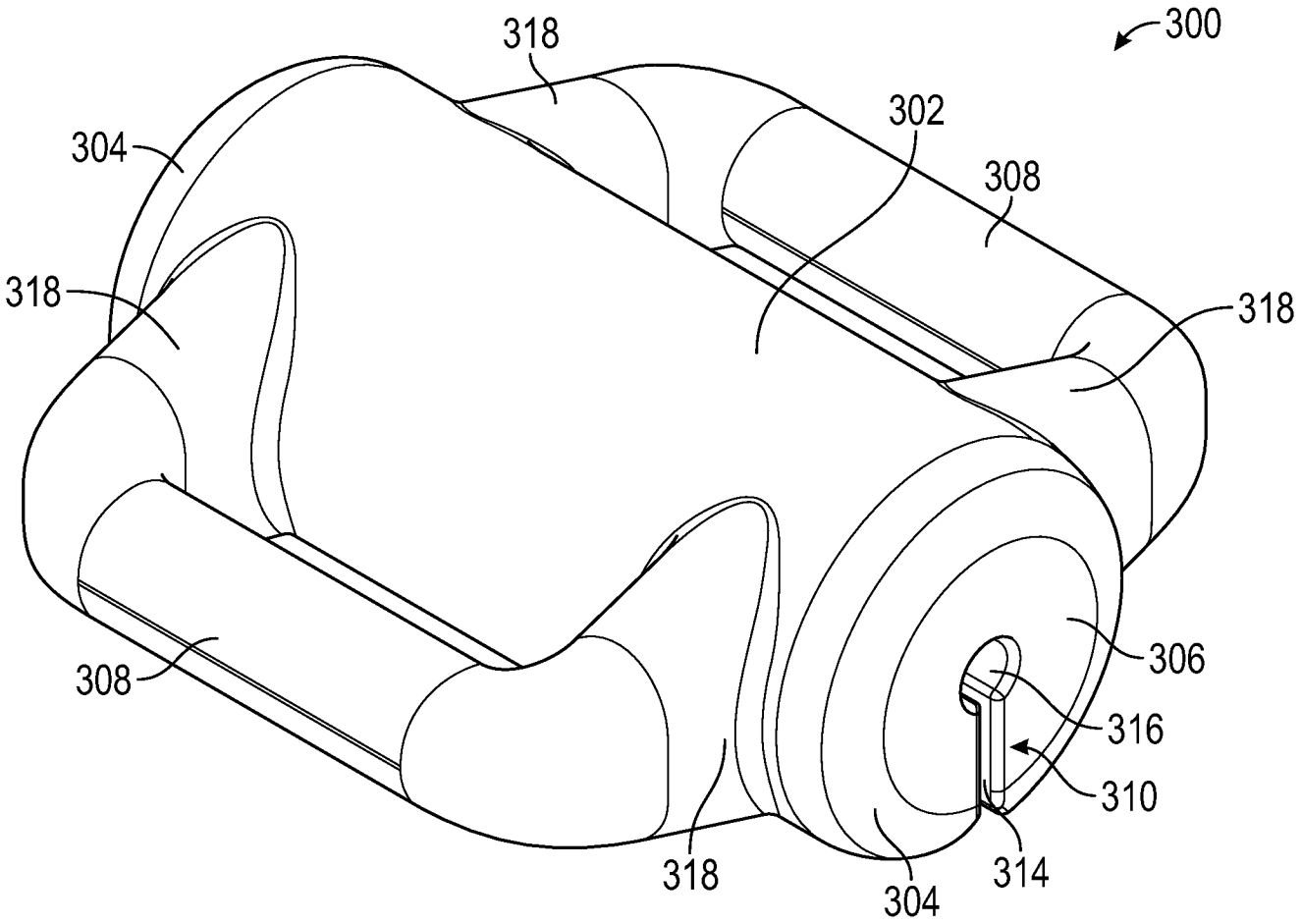
FIG. 12 shows a perspective view of a flotation device.
Figure 13:
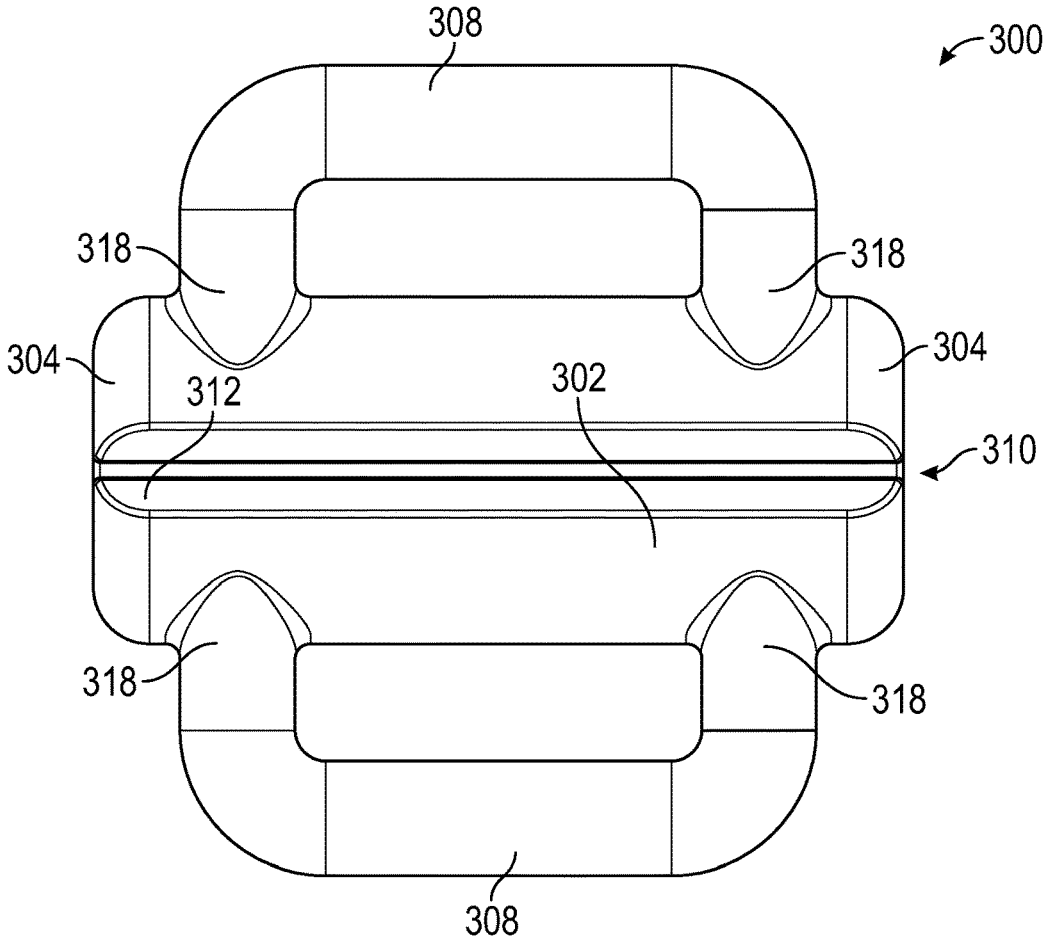
FIG. 13 shows a side elevation view of the flotation device of FIG. 12.
Figure 14:
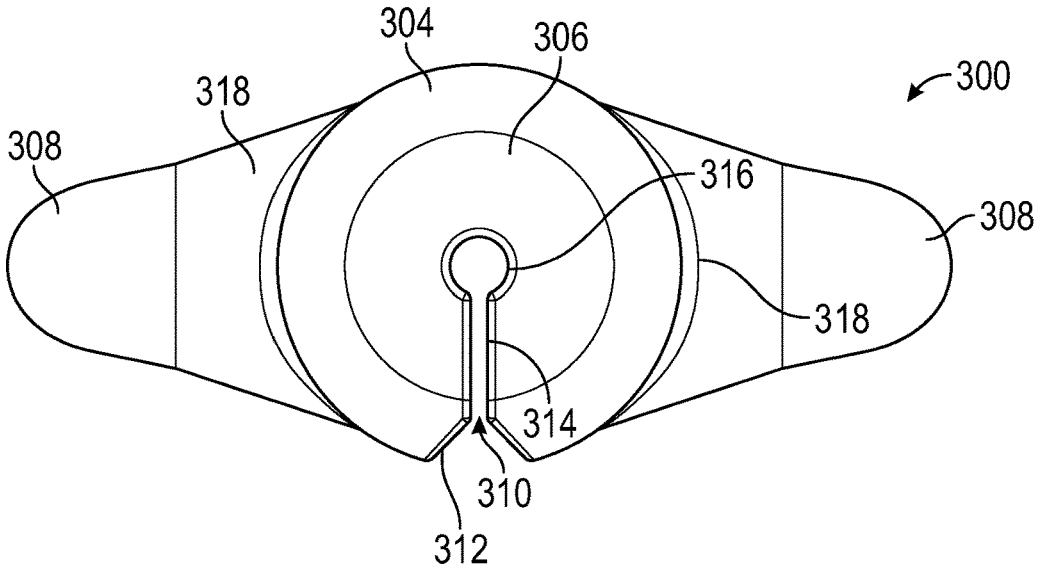
FIG. 14 shows a top elevation view of the flotation device of FIGS. 12 and 13.

FIGS. 12-14 show an embodiment of a flotation device 300 that includes a body 302, wherein the body comprises two sloped portions 304 and two ends 306. The sloped portions 304 can connect the body 302 to each end 306. The body 302 is generally cylindrical wherein each extremity of the body 302 includes a sloped portion 304 that each culminate at a generally flat end 306. While this embodiment of the flotation device 300 is cylindrical, the flotation device 300 could take any suitable shape according to other embodiments.

As shown in FIGS. 12-14, the flotation device 300 can include a slot 310 wherein there is a gap in a portion of the device 300 such that the center of the device 300 is exposed. The slot 310 can comprise an outer portion 312, an inner portion 314 and a center portion 316.

The outer portion 312 can be sloped in that it can include two sloped faces that are slanted such that they create a wider gap toward the outer edge of the device 300 and narrow as the faces extend inward. In this way, the outer portion 312 of the slot 310 can be shaped generally as a "V" wherein the point of the "V" points to the center of the device 300. This shape of the outer portion 312 of the slot 310 allows for a line, rope, or other object, to easily enter the slot 310 via the outer portion 312 wherein the line, rope, or other object, is directed inward toward the inner portion 314 of the slot 310 and then toward the center portion 316 of the slot 310. While the outer portion 312 of the embodiment of FIGS. 12-14 has a "V" shape, any suitable shape could be used for the outer portion 312.

According to some embodiments, the inner portion 314 of the slot 310 comprises two opposing faces and is generally straight. However, according to some embodiments, the inner portion 314 can be of any suitable shape. The inner portion 314 is operatively connected to the outer portion 312 toward the outer edge of the device 300 and is operatively connected to the center portion 316 of the slot 310 toward the center of the device 300. The inner portion 314 facilitates movement of a line, rope, or other object, from the outer portion 312 to the center portion 316 and/or from the center portion 316 to the outer portion 312.

The center portion 316 of the slot 310 is generally circular in shape in the embodiment of FIGS. 12-14. However, according to some embodiments, the center portion 316 can be of any suitable shape. The center portion 316 is operably connected to the inner portion 314 to receive a line, rope, or other object, from the inner portion 314. The center portion 316 is configured to secure and/or hold in place a line, rope, or other object, once it is received from the inner portion 314. Thus, a line, rope, or other object can enter the outer portion 312, move to the inner portion 314, and then move to the center portion 316 where it is secured and/or held in place.

The embodiment of FIGS. 12-14 is similar to the embodiment of FIGS. 3-11. The embodiment of FIGS. 12-14 comprises similar features as those of the embodiment of FIGS. 3-11. The embodiment of FIGS. 12-14 is able to operate in the same manner and comprises all the functionality of the embodiment of FIGS. 3-11.

The embodiment of FIGS. 12-14 also includes two handles 308 connected to the body 302 of the device 300. While the embodiment of FIGS. 12-14 comprises two handles 308, any number of handles ranging from zero to N could be included wherein N is any number greater than zero. The handles 308 can be attached to the body 302 via molding or any other suitable means for attachment. The handles 308 can be configured so as to be easily grabbed/held by a hand of a user such that a user can easily throw, position, place, and/or retrieve the device 300. Additionally, the handles 308 allow for the device 300 to be easily retrieved via tools such as a hook, claw, handle, broom, pole, and the like. Additionally, the handles 308 provide for flotational stability in that the handles 308 can serve to keep the flotation device 300 stable while floating in water or other liquid.

Each handle 308 of the embodiment of FIGS. 12-14 further includes a handle base attachment 318 at each end of each handle 308 to attach each handle 308 to the body 302 of the device 300. The handle base attachment 318 can have a rounded and/or wide base such that the base of the handle base attachment 318 generally takes the shape of at least a portion of the body 302 as can be seen in FIGS. 12 and 14. The handle base attachments 318 can at least partially be rounded such that they at least partially take the shape of the cylindrical body 302. The handle base attachments 318 help to make the device 300 more durable and easier to grip. Additionally, the shape and nature of the handle base attachments 318 help to make the device 300 more aerodynamic such that when the device 300 is thrown and/or cast out, the device 300 is able to travel farther and more accurately. Further, the shape and nature of the handle base attachments 318 and handles 308 facilitate improved flotation and/or buoyancy of the device 300.

Although not shown in the Figures, the device 300 is capable of receiving and securing, anchoring, and/or holding in place a rope/line in the same manner as the device 200. Further, although not shown in the Figures, the device 300 is capable of floating in water and securing, anchoring, and/or holding in place the rope/line while floating in water in the same manner as the device 200.

An embodiment of a flotation device 400, and components thereof, is shown in FIGS. 15-30C. The flotation device 400 of FIGS. 15-30C includes a body 402, a head member 404, and a connecting member 406. The device 400 further includes a slot 408 wherein a line, rope, or other object such as a boat/dock line can be inserted into the slot 408. The slot 408 comprises a body portion 408A that extends through the body 402, a head member portion 408B that extends through the head member 404, and a connecting member portion 408C that extends through the connecting member 406.

Figure 15:
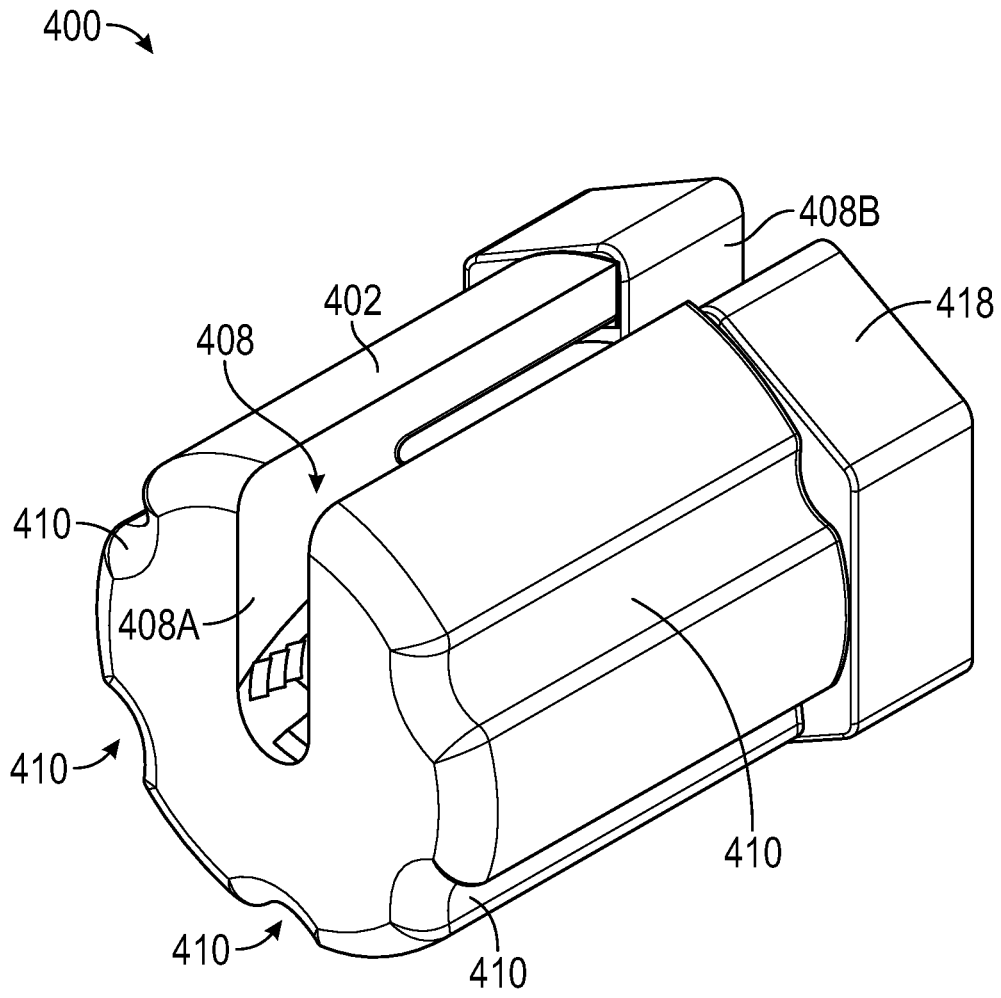
FIG. 15 shows a right-hand perspective view of a flotation device.
Figure 16:
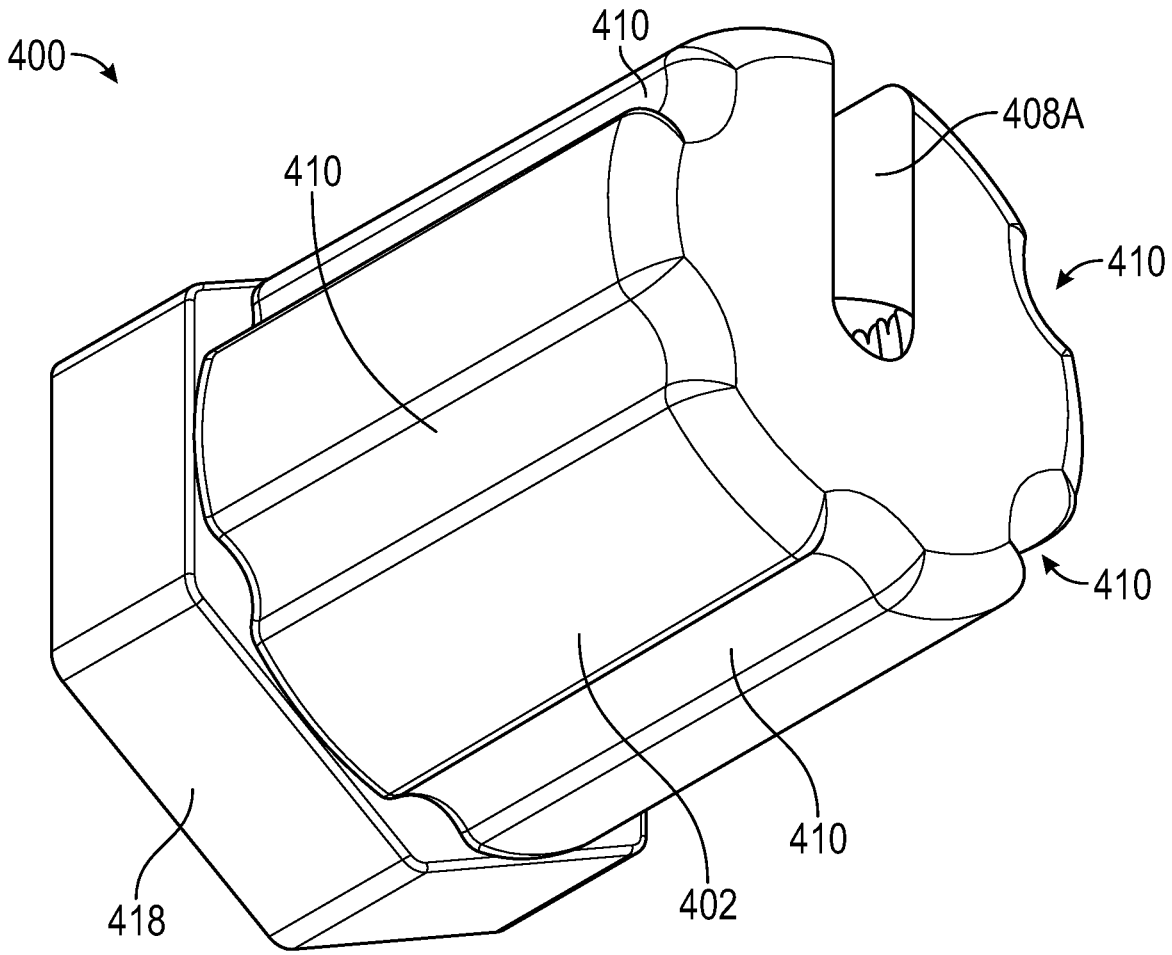
FIG. 16 shows a left-hand perspective view of the flotation device of FIG. 15.

FIGS. 15 and 16 each show a different view of the fully assembled device 400. As shown in FIGS. 15 and 16, the body 402 can include grooves 410. For example, the embodiment shown in FIGS. 15 and 16 includes 5 grooves 410, however any number of grooves ranging from zero to N could be included where N is any number greater than zero. The grooves 410 allow for the device 400 to be aerodynamic when thrown or cast out. The grooves also create air pockets to allow for enhanced flotation.

Figure 17:
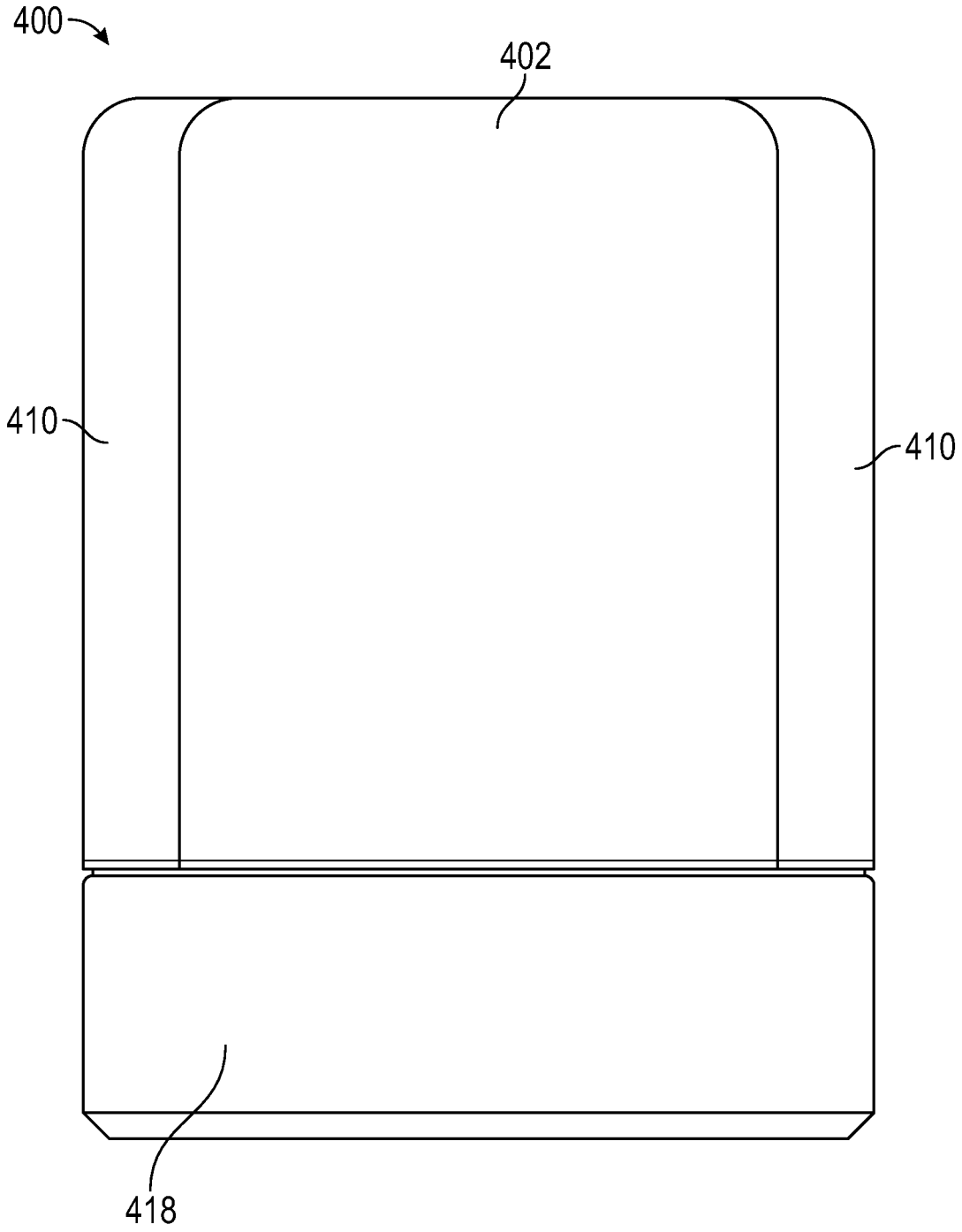
FIG. 17 shows a side elevation view of the flotation device of FIGS. 15 and 16.

FIG. 17 shows a side view of the fully assembled device 400. When fully assembled, portion(s) of the head member 404 can be inserted into the body 402 wherein the base 418 of the head member 404 protrudes from the body 402. The base 418 of the head member 404 can be any suitable shape. For example, the base 418 of the embodiment of FIGS. 15-30C has six sides. According to some embodiments, the base 418 can have any number of sides ranging from zero to N where N is any number greater than zero. Additionally, according to some embodiments, the based 418 can be generally circular in shape.

Figure 18:
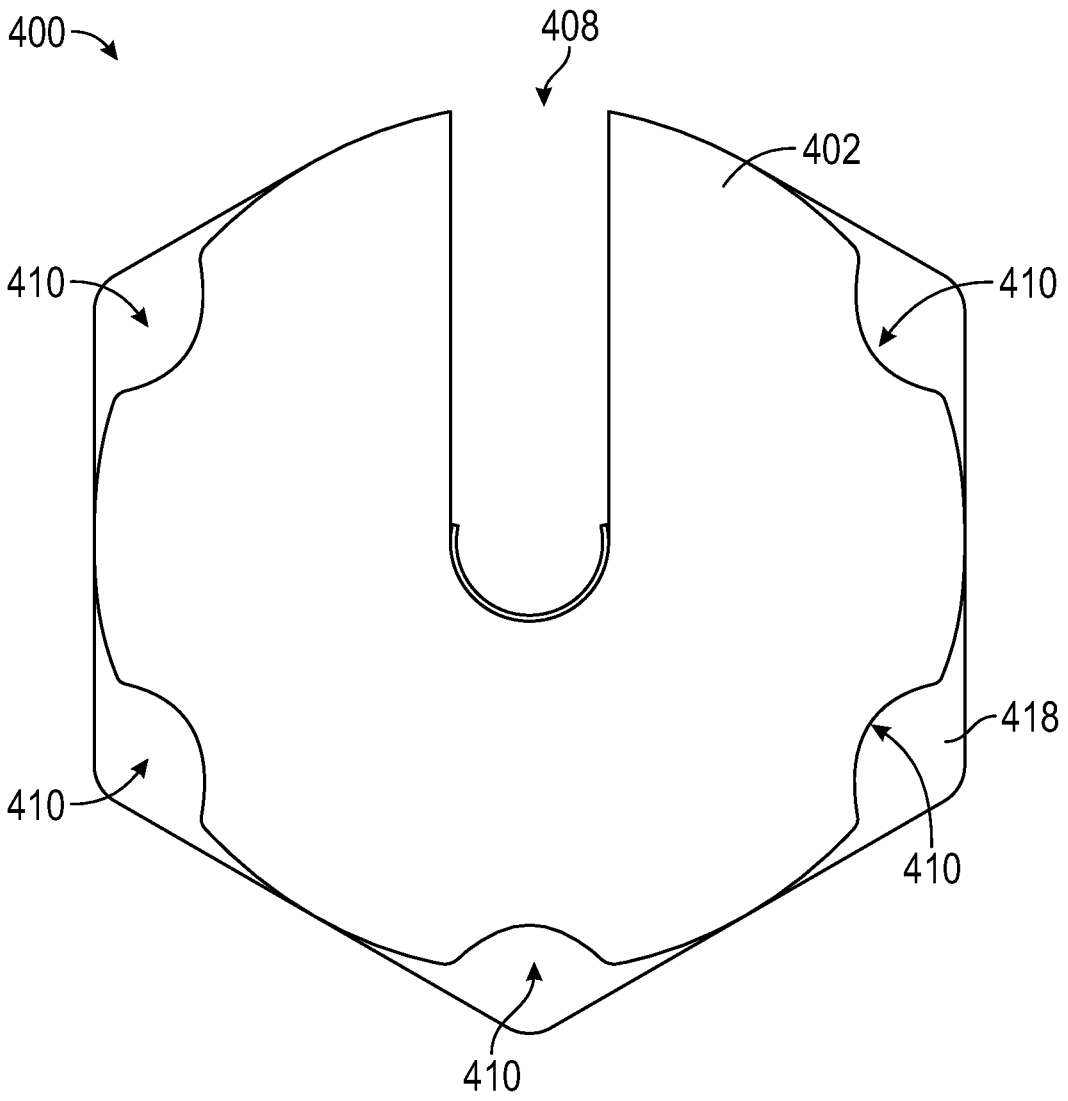
FIG. 18 shows a top elevation view of the flotation device of FIGS. 15-17.

FIG. 18 shows a top view of the fully assembled device 400. The body portion 408A of the slot 408, head member portion 408B of the slot 408, and connecting member portion 408C of the slot 408 can each be aligned such that the slot 408 extends among the body 402, head member 404, and connecting member 406 to create a trench through the entirety of the device 400.

Figure 19:
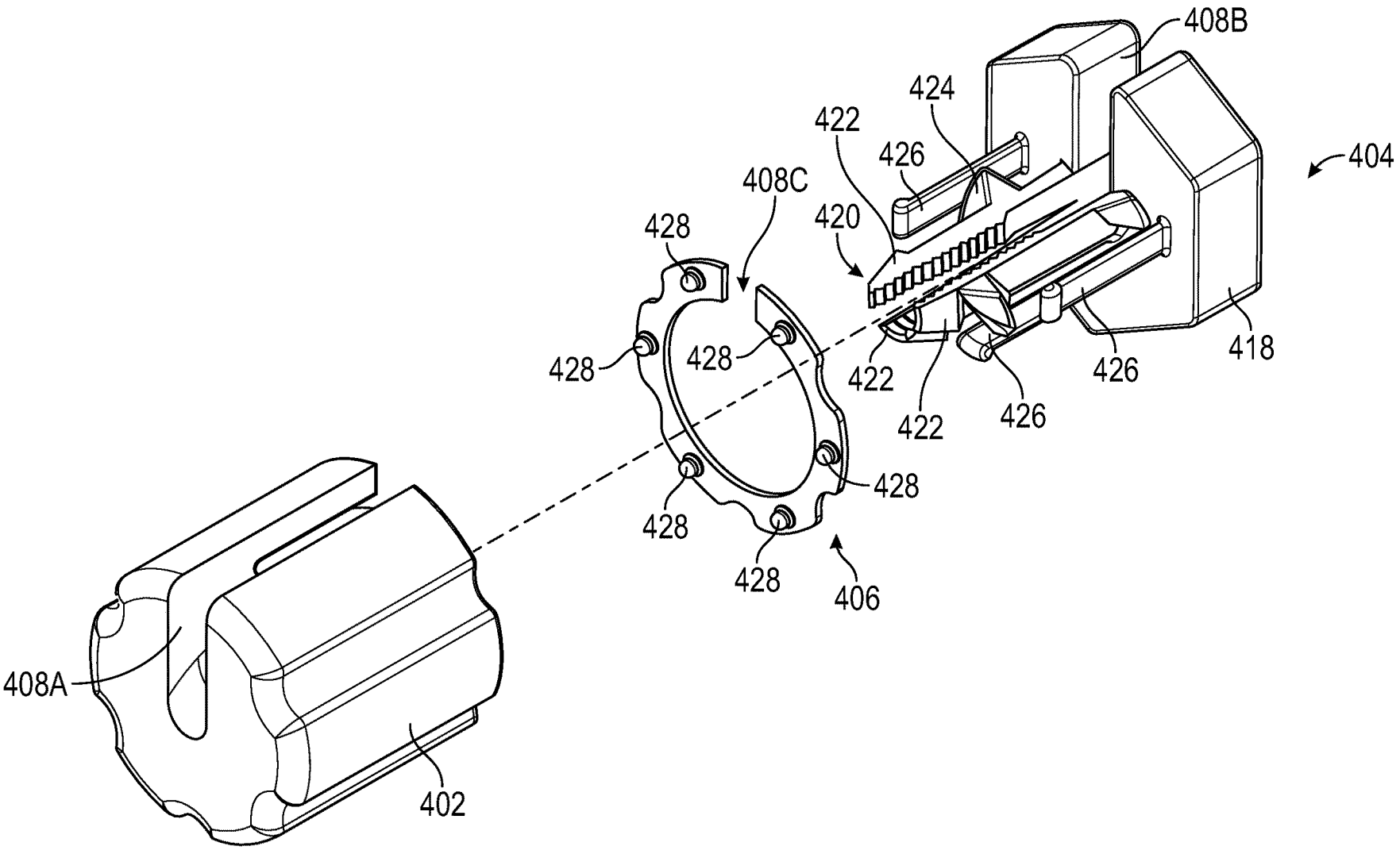
FIG. 19 shows a right-hand, perspective, exploded view of the flotation device of FIGS. 15-18.
Figure 20:
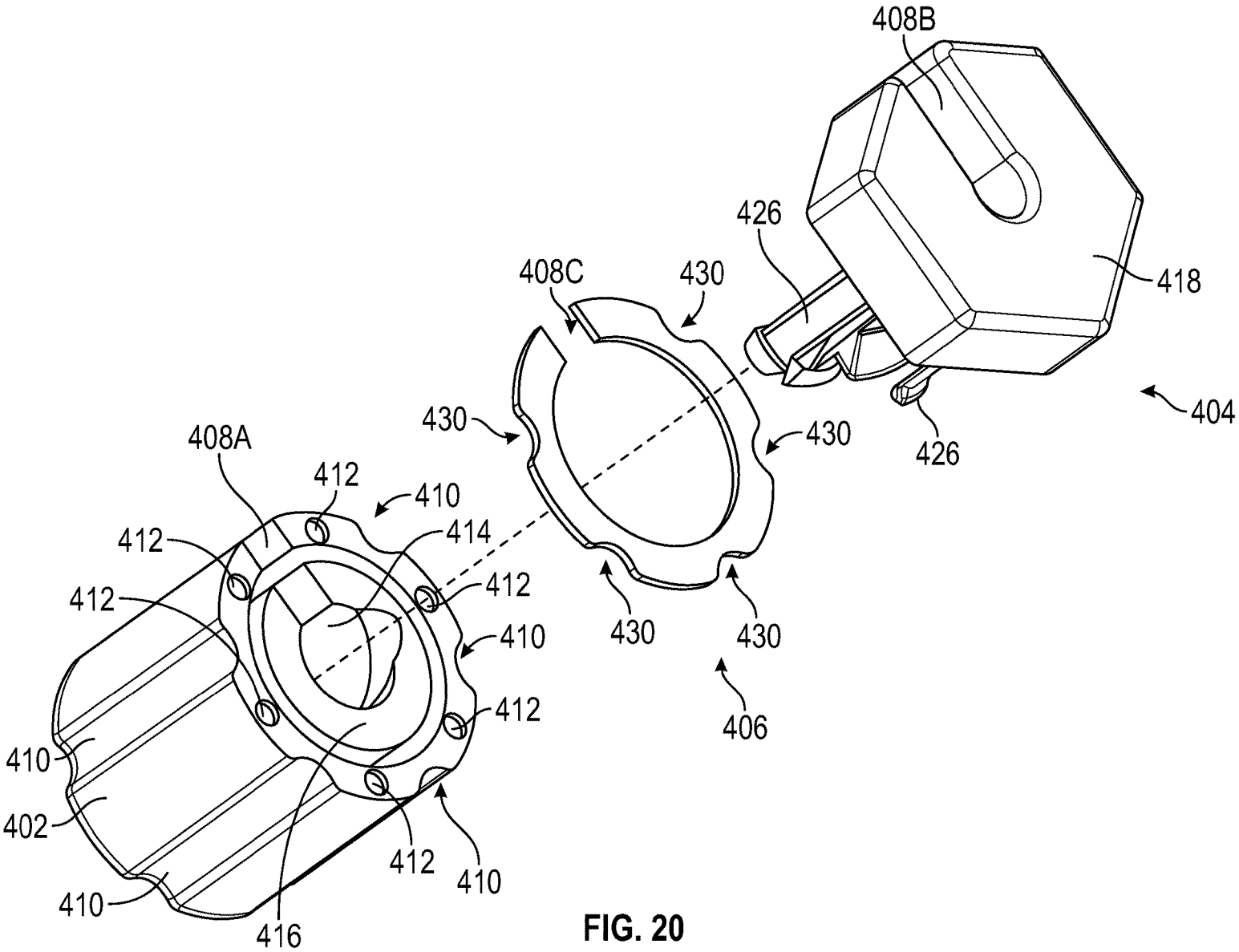
FIG. 20 shows a rear, perspective, exploded view of the flotation device of FIGS. 15-19.
Figure 21:
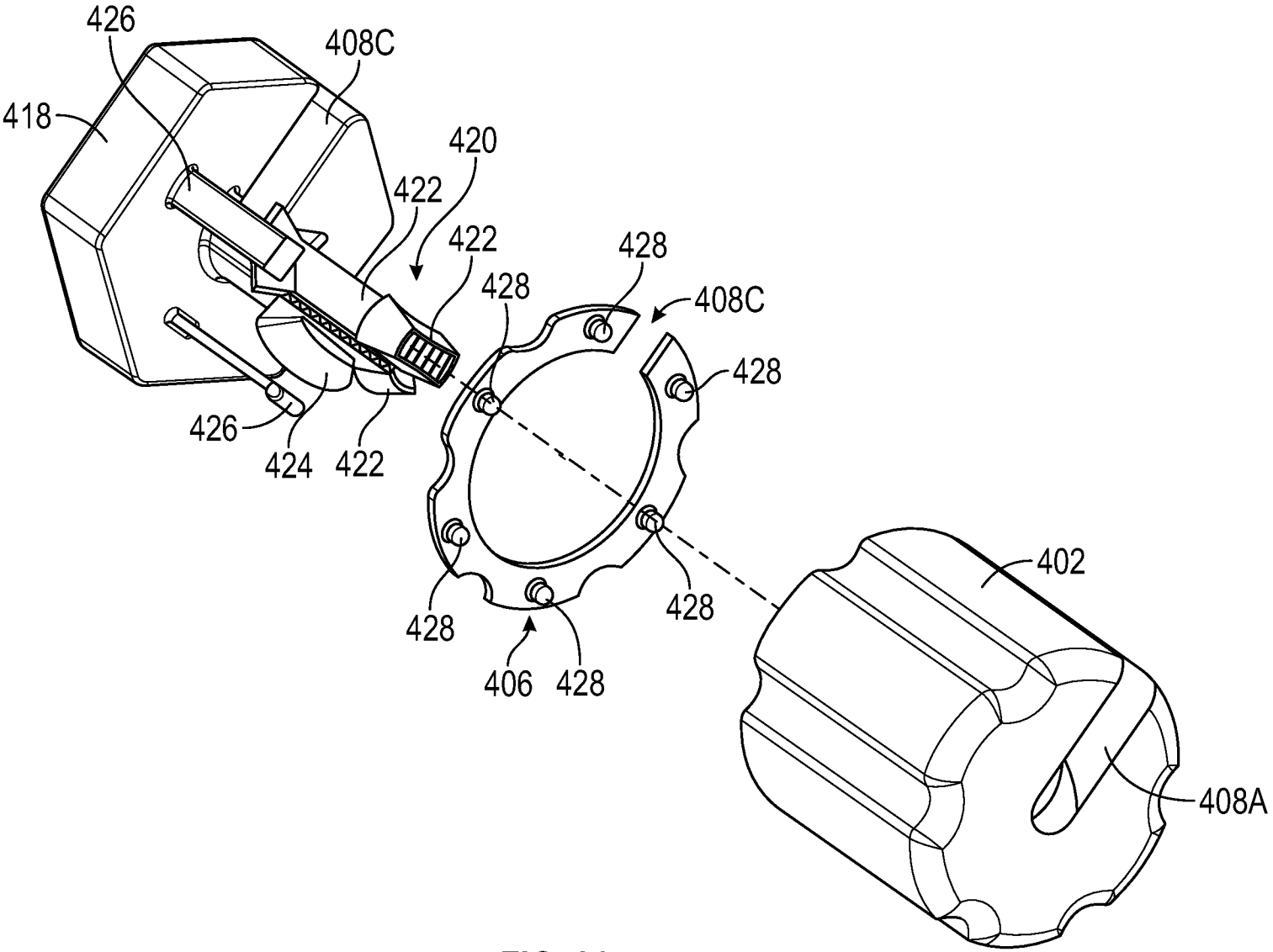
FIG. 21 shows a left-hand, perspective, exploded view of the flotation device of FIGS. 15-20.
Figure 22:
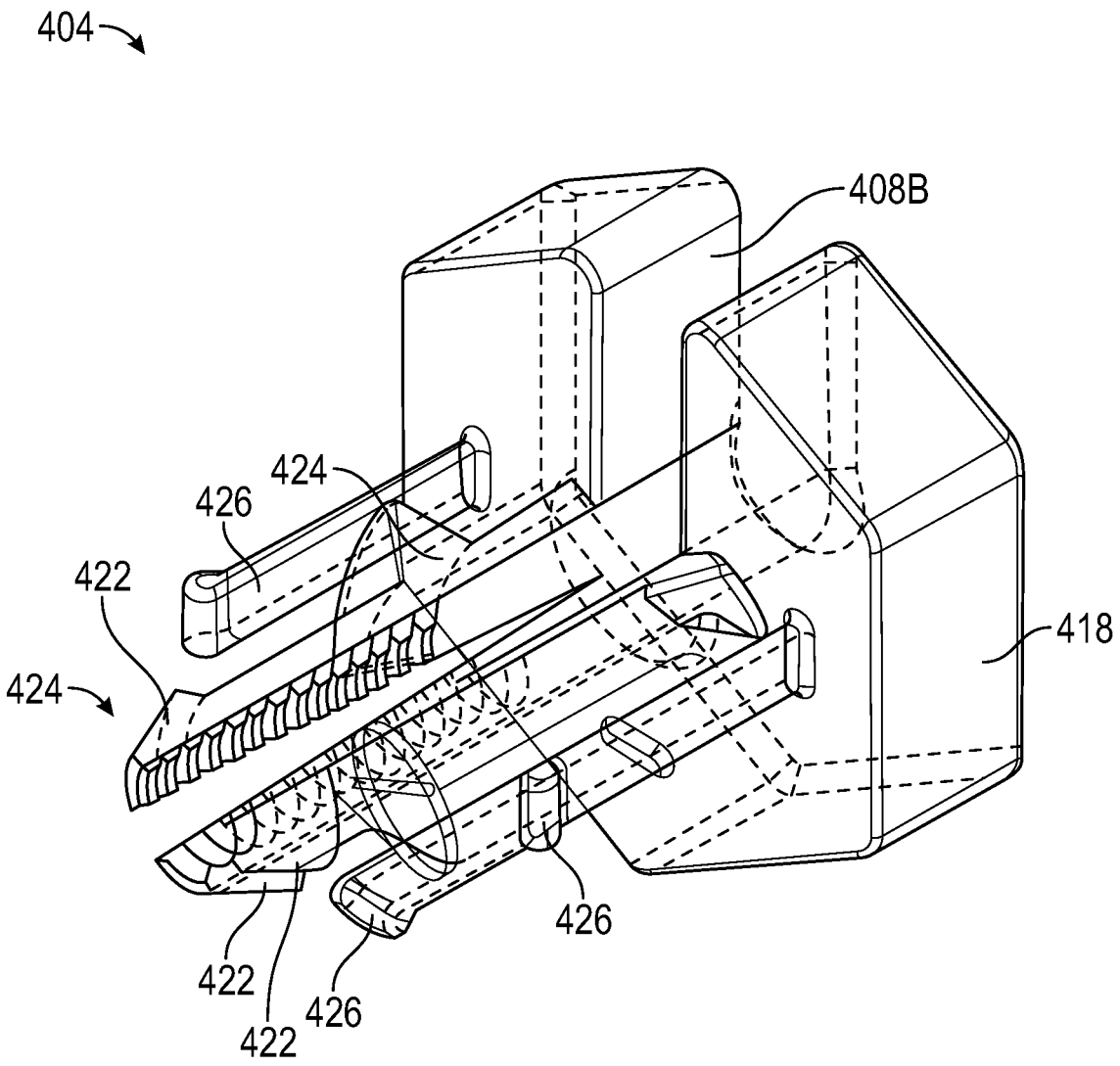
FIG. 22 shows a perspective view of a head member of the flotation device of FIGS. 15-21.
Figure 23:
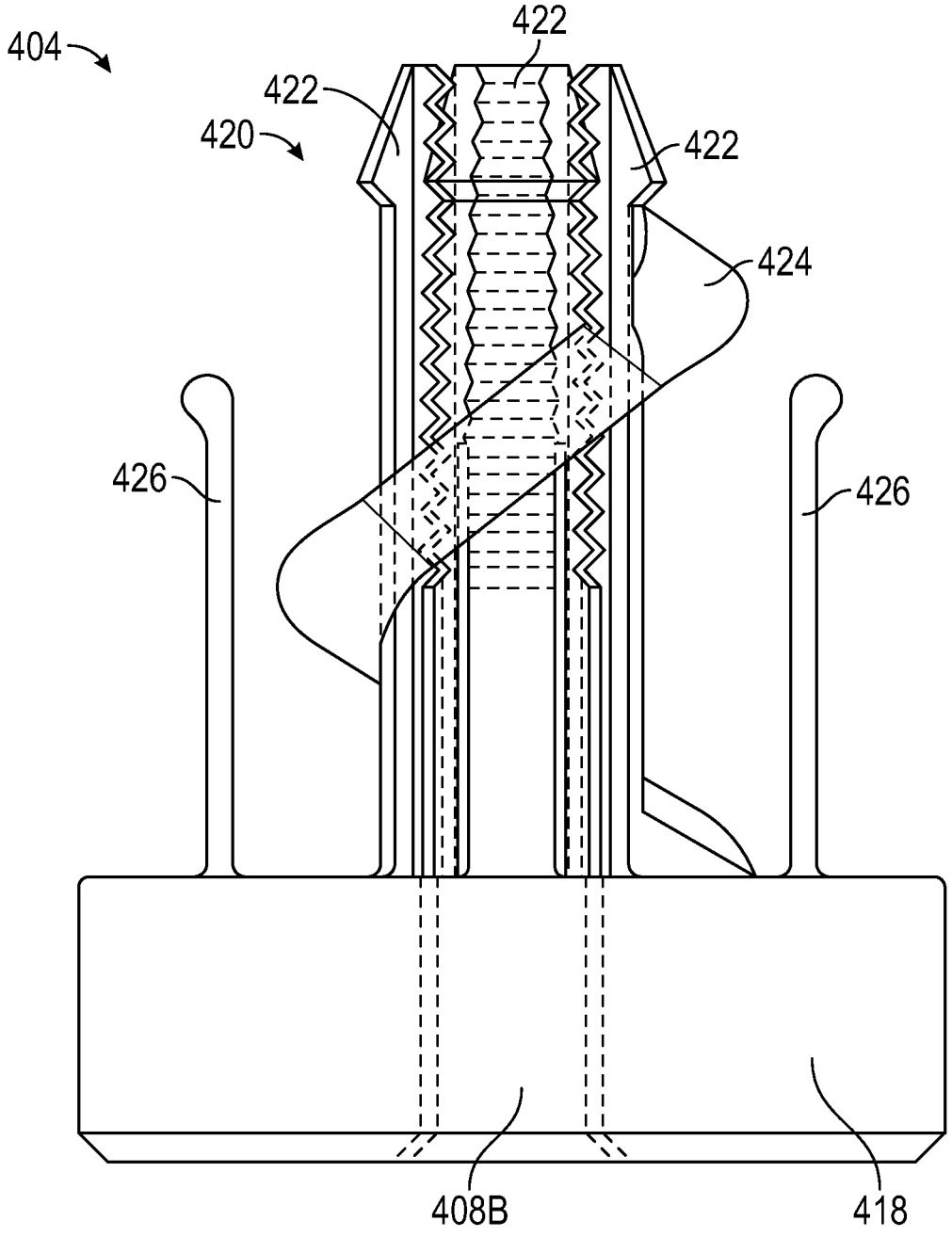
FIG. 23 shows a side elevation view of the head member of FIG. 22.
Figure 24:
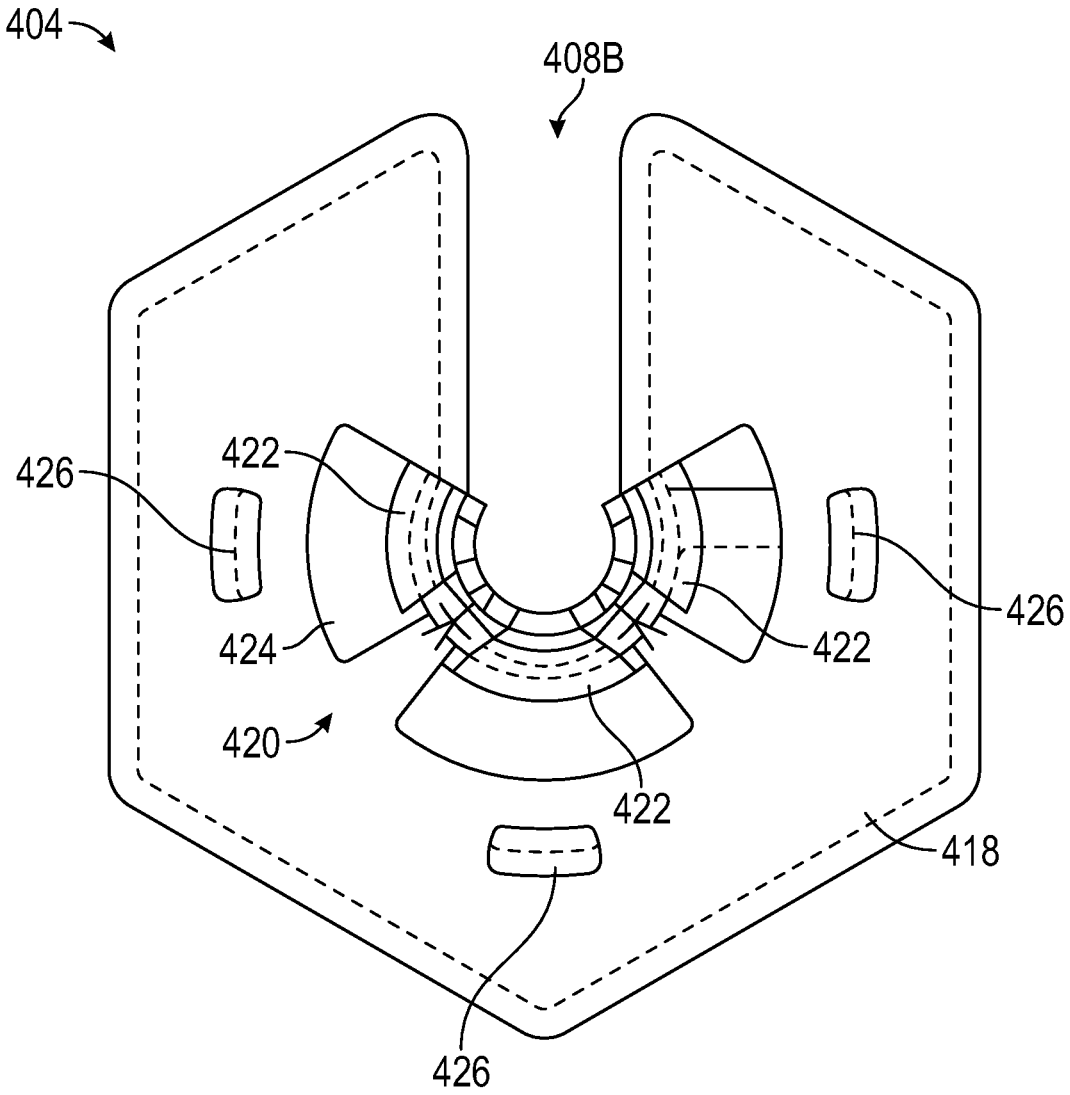
FIG. 24 shows a top elevation view of the head member of FIGS. 22 and 23.
Figure 25:
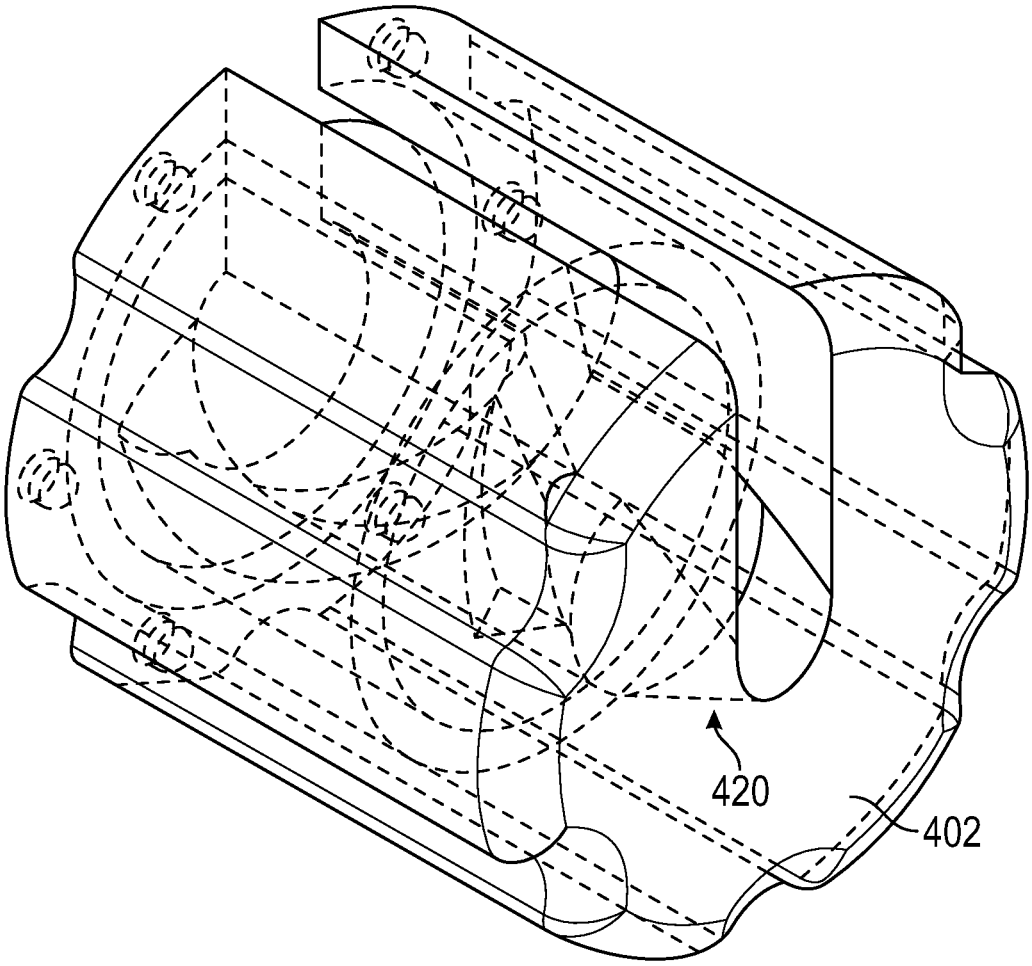
FIG. 25 shows a left-hand, perspective view of the body and partial head member of the flotation device of FIGS. 15-24.
Figure 26:
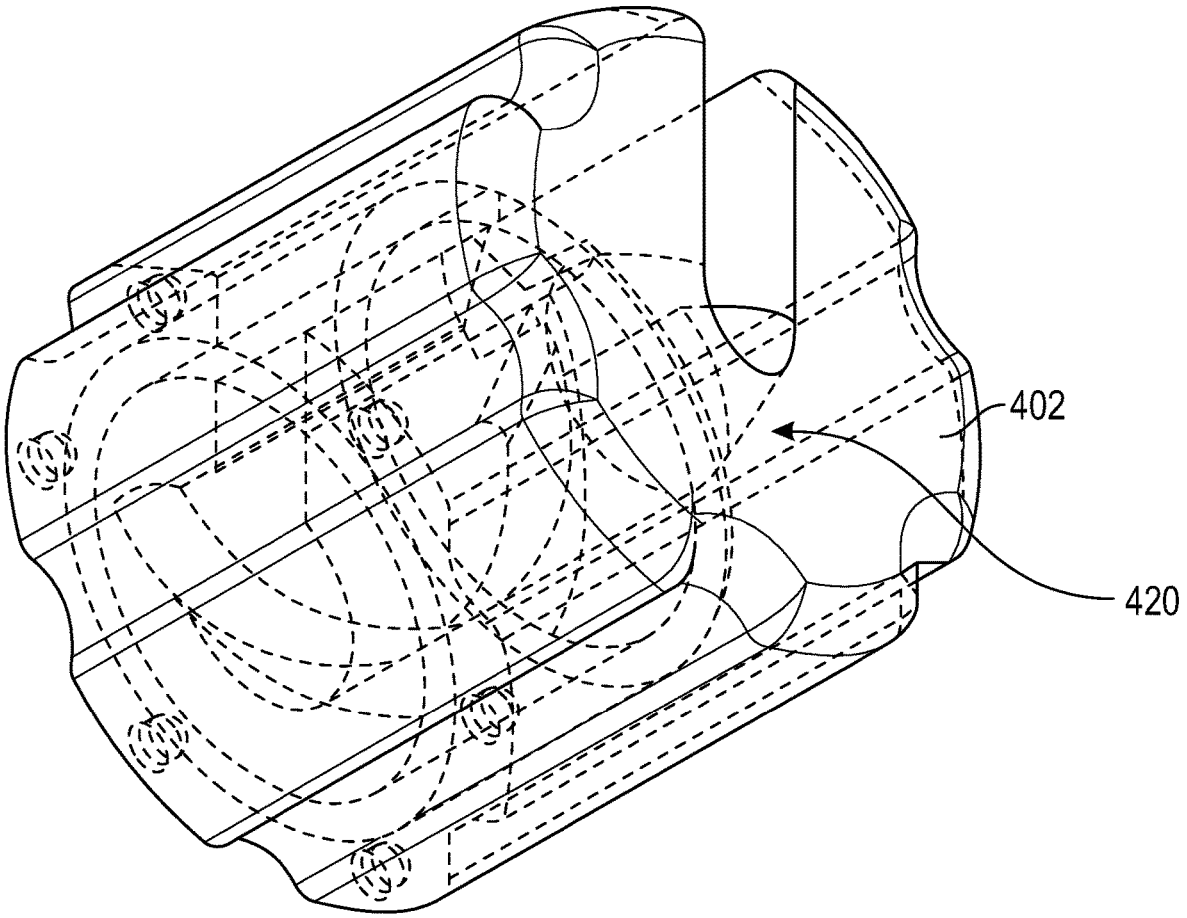
FIG. 26 shows a bottom, perspective view of the body and partial head member of FIG. 25.

FIGS. 19-21 show different exploded views of the device 400. The connecting member 406 can be positioned between the body 402 and the head member 404 wherein the body 402 and head member 404 are connected via the connecting member 406. Each portion of the slot 408 is visible in FIGS. 19-21, including the body portion 408A, head member portion 408B, and connecting member portion 408C. The connecting member 406 can include a plurality of connection means 428 such as protrusions, apertures, and/or any other suitable apparatus(es) used for connection. Although FIGS. 19 and 21 shows 6 connection means 428, any number of connection means 428 ranging from zero to N could be included where N is any number greater than zero. As shown in FIG. 20, the body can include a plurality of receiving connection means 412 that correspond to the connection means 428 of the connecting member 406. While FIG. 20 shows 6 receiving connection means 412, any number of receiving connection means 412 ranging from zero to N could be included where N is any number greater than zero. For example, according to some embodiments, the connection means 428 of the connecting member 406 can be protrusions and the receiving connection means 412 of the body 402 can be apertures wherein each protrusion is inserted into a corresponding aperture to create a snap fit connection between the connecting member 406 and the body 402. According to some embodiments, the connection means 428 of the connecting member 406 can be screws and the receiving connection means 412 of the body 402 can be apertures wherein each screw is inserted into a corresponding aperture to create a screw connection between the connecting member 406 and the body 402. According to some embodiments, connection between the body 402 and the connecting member 406 can be achieved by any suitable means such as snap fit, screw fit, nut and bolt connection, interlocking raised edges, and the like.

Additionally, the connecting member 406 can include grooves 430 that can correspond to the grooves 410 of the body 402 such that the grooves extend through the body 402 and the connecting member 406 as can be seen in the top view of FIG. 18. While the connecting member 406 has 5 grooves 430 in the embodiment of FIGS. 19-21, the connecting member 408 can have any number of grooves 430 ranging from zero to N where Nis any number greater than zero.

As can be seen in FIGS. 19 and 22-24, the head member 404 can include a tower 420, wherein the tower 420 can include tower protrusions 422 and a helical member 424. The head member 404 can further include surrounding protrusions 426 that surround the tower 420. The tower 420, including the tower protrusions 422 and helical member 424, and the surrounding protrusions 426 can extend from the base 418 of the head member 404. The tower protrusions 422 can be positioned in a generally circular formation wherein an opening and/or gap remains where the head member portion 408B of the slot 408 occurs. The helical member 424 can have a helical nature and can wrap around the tower protrusions 422. While FIGS. 19 and 22-24 show 3 tower protrusions 422, any number of tower protrusions 422 ranging from zero to N could be included where N is any number greater than zero.

As shown in FIGS. 19 and 22-24, the surrounding protrusions 426 can be positioned in a generally circular formation surrounding the tower 420 wherein an opening and/or gap remains where the head member portion 408B of the slot 408 occurs. While FIGS. 19 and 22-24 show 3 surrounding protrusions 426, any number of surrounding protrusions 426 ranging from zero to N could be included where N is any number greater than zero.

Figure 27:
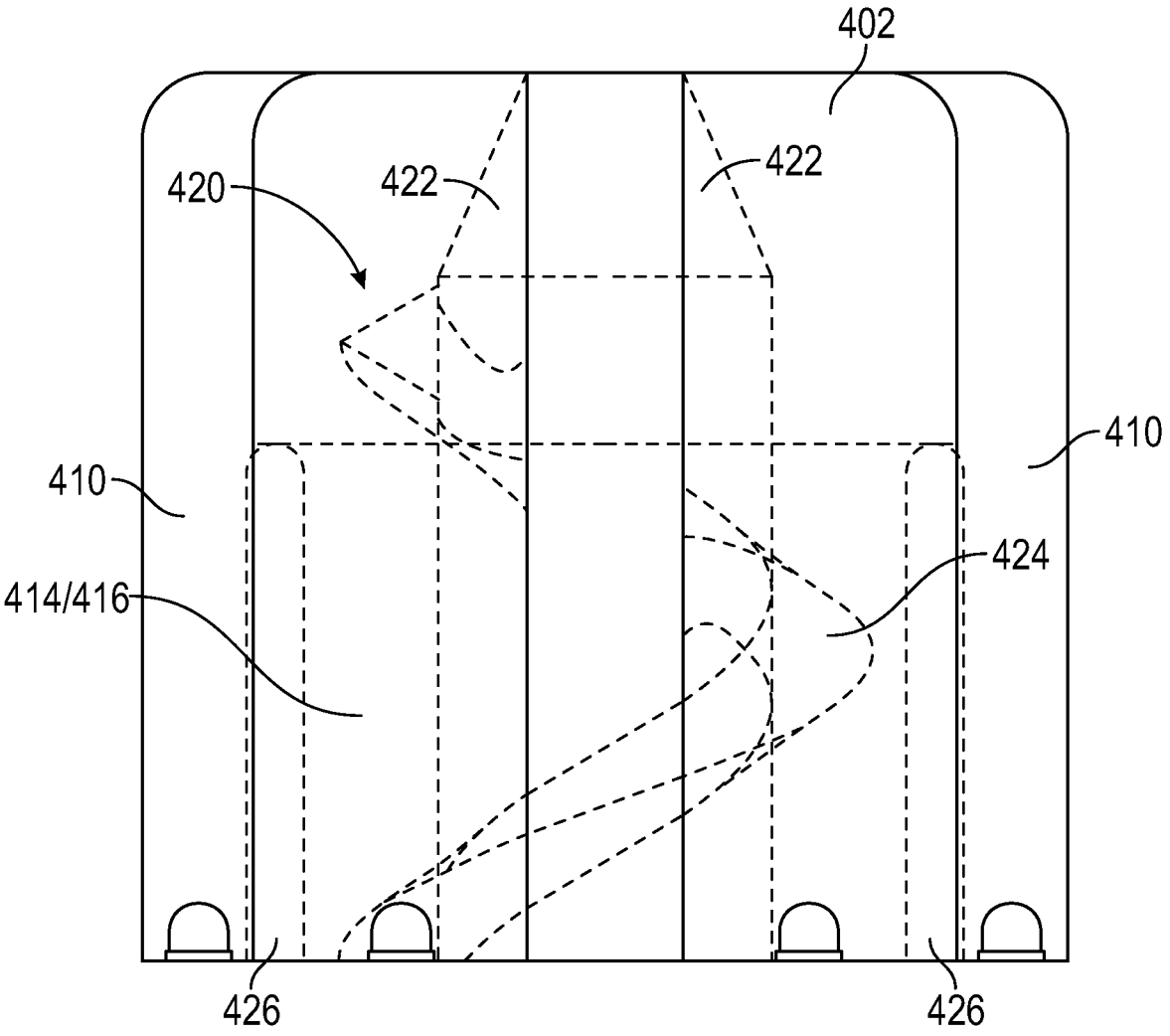
FIG. 27 shows a side elevation view of the body and partial head member of FIGS. 25 and 26.
Figure 28:
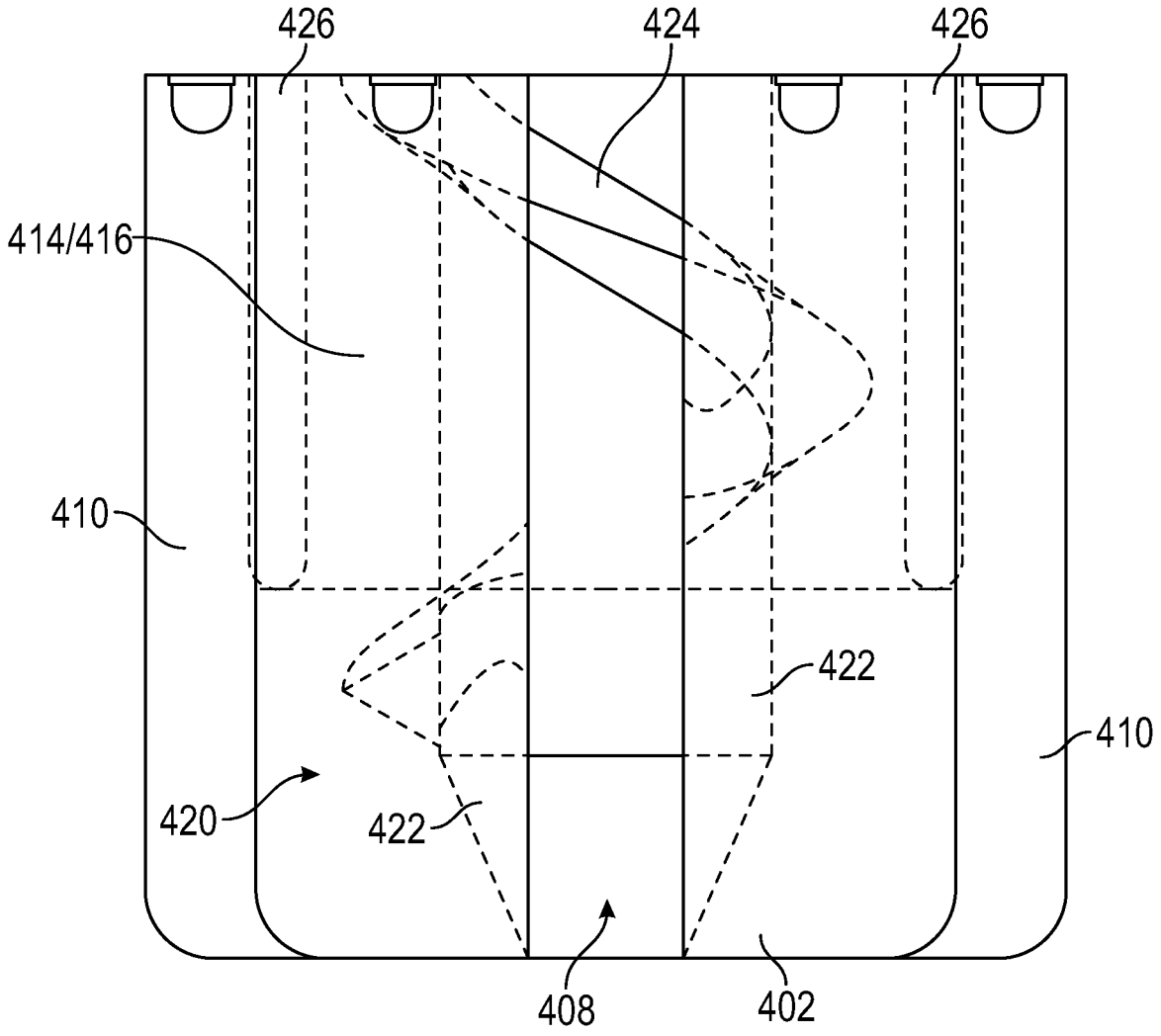
FIG. 28 shows an inverted, side, elevation view of the body and partial head member of FIGS. 25-27.
Figure 29:
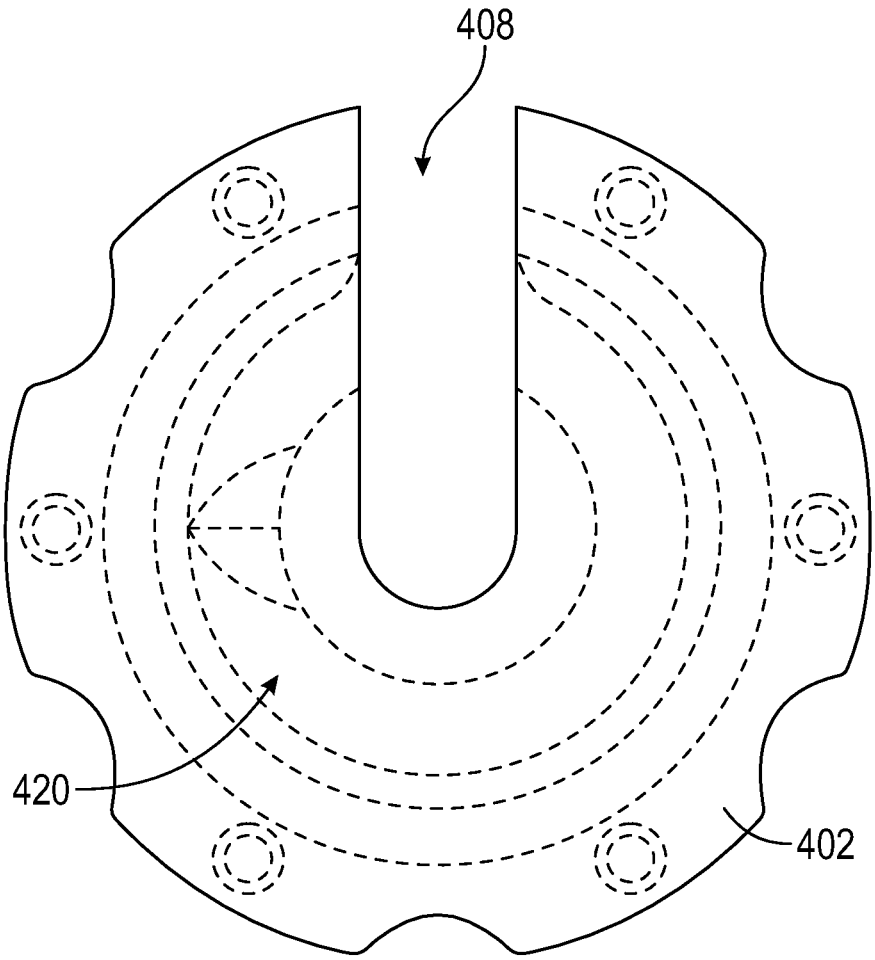
FIG. 29 shows a top elevation view of the body and partial head member of FIGS. 25-28.

As shown in FIGS. 19-21 and 25-29, portion(s) of the head member 404 are inserted into the body 402 when the device 400 is fully assembled. For example, the tower 420 and surrounding protrusions 426 are inserted into the body 402. The tower 420 can be received by the body 402 via the inner receiving portion 414, and the surrounding protrusions 426 can be received by the body via the outer receiving portion 416. The connecting member 406 can facilitate connection between the body 402 and the head member 404. The head member 404 can be snap fit into the body 402, can be twisted into the body 402, and/or connection between the head member 404 and the body 402 can be achieved by any suitable apparatus and/or method. For example, according to some embodiments, the helical member 424 of the tower 420 can facilitate connection between the head member 404 and the body 402 by allowing portion(s) of the head member 404, including at least the tower 420 and surrounding protrusions 426, to be screwed into the body 402 via the inner and/or outer receiving portion(s) 414/416. According to some embodiments, the connecting member 406 can be positioned between the head member 404 and the body 402 to act as a spacer/buffer and/or to facilitate connection between the head member 404 and the body 402. As shown in FIGS. 27 and 28, in a fully assembled form when the head member 404 is inserted into the body 402, the top of each tower protrusion 422 is positioned at, in contact with, and/or near the underside of an end of the body 402. As shown in FIGS. 27 and 28, according to some embodiments, the tower 420 and/or surrounding protrusions 426 can be received and secured and/or held in place by the inner and/or outer receiving portion(s) 414/416. As shown in FIGS. 27 and 28, according to some embodiments, the inner and/or outer receiving portion(s) 414/416 can fill a portion of the body 402 and the tower 420 can extend beyond the inner and/or outer receiving portion(s) 414/416. According to some embodiments, the inner and/or outer receiving portion(s) 414/416 can be generally the same and/or similar in height as the surrounding protrusions 426.

Figure 30A:
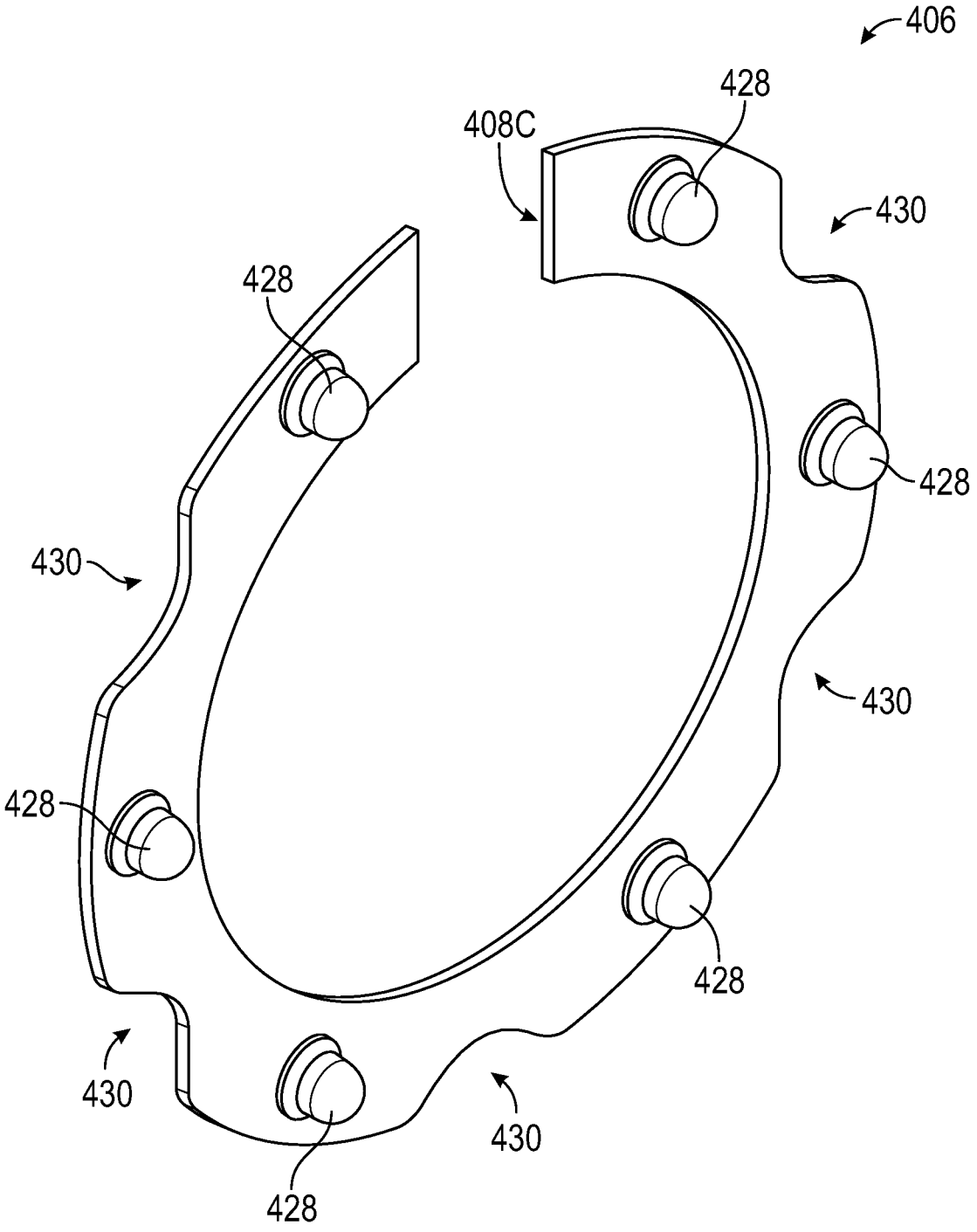
FIG. 30A shows a perspective view of the connecting member of the flotation device of FIGS. 15-21.
Figure 30B:
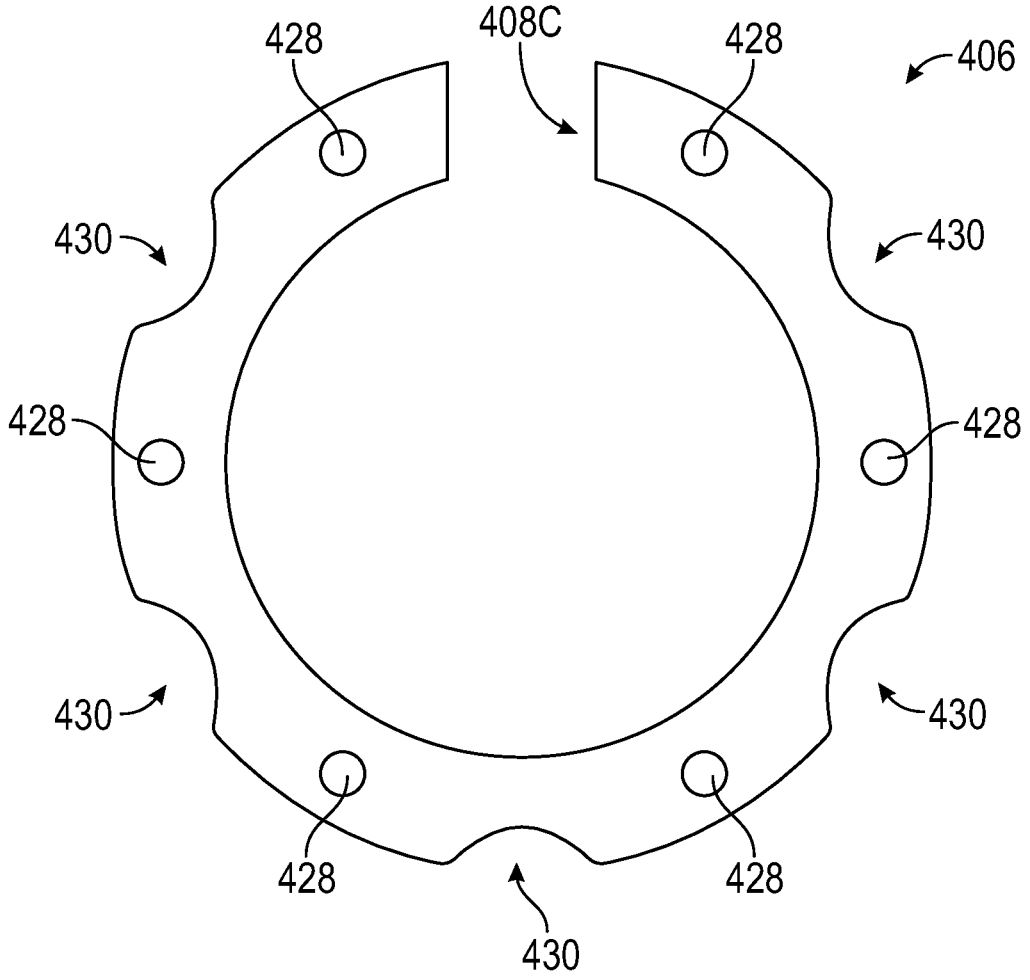
FIG. 30B shows a top elevation view of the connecting member of FIG. 30A.
Figure 30C:
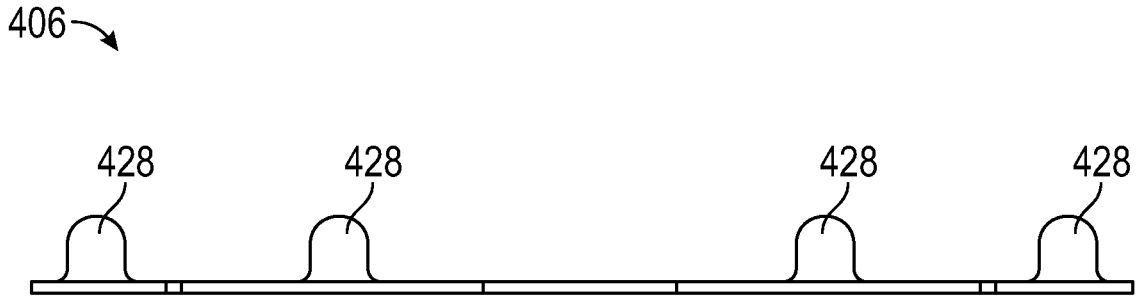
FIG. 30C shows a side elevation view of the connecting member of FIGS. 30A and 30B.

FIGS. 30A-C show different views of the connecting member 406. As mentioned, the connecting member 406 can include zero or more connecting means 428 and zero or more grooves 430. According to some embodiments, when in a fully assembled form, the grooves 430 of the connecting member 406 are aligned with the grooves 410 of the body 402. The connecting member 406 can facilitate connection between the body 402 and the head member 404 and/or can act as a buffer/spacer between the body 402 and head member 404.

As mentioned above, in a fully assembled formation, the body portion 408A, head member portion 408B, and connecting member portion 408C of the slot 408 are all aligned to create a channel, trench, and/or slot 408 through the body 402, head member 404, and connecting member 406 that extends through the entire device 400. A line, rope, and/or another object, such as a boat/dock line can be inserted into the slot 408. According to some embodiments, in a fully assembled form, the base 418 of the head member 404 can essentially operate as a cap and be positioned at, in contact with, and/or near an edge of the body 402 where the inner and outer receiving portions 414/416 are exposed. A user can then throw and/or cast out the device 402 into a body of water such as a pool, pond, lake, sea, ocean, and the like, wherein the device 402 will keep the line, rope, and/or other object, afloat.

According to some embodiments, including the device 100 of FIGS. 1 and 2, the device 200 of FIGS. 3-11, the device 300 of FIGS. 12-14, and the device 400 of FIGS. 15-30C, external component(s) of the device can be made of a soft material such that when the device is thrown and/or cast out harm and/or damage to anyone or anything is eliminated and/or minimized.

Therefore, as understood by the present disclosure, the flotation device provided herein includes the ability to provide flotation for boat lines, dock lines, ropes, and the like. Further, the device disclosed herein provides for improved and/or enhanced grip of boat lines, dock lines, ropes, and the like. Further, the presently disclosed device provides the ability to employ coverings for boat lines, dock lines, and/or ropes while keeping such boat lines, dock lines, and/or ropes out of, and/or above, the water. Further, the presently disclosed device provides weight that can be applied to the end of rope, dock line, boat line, and the like, to improve the distance that such a rope, dock line, and/or boat line could be thrown without losing the same in the water. Additionally, the weight created by the device allows for a rope, dock line, boat line, and the like to be thrown with greater accuracy such that it is easier to direct the rope, dock line, and/or boat line to a desired position. Additionally, providing weight to a rope, dock line, and/or boat line allows for better accuracy when throwing the rope, dock line, and/or boat line in inclement weather conditions such as weather conditions that include wind, rain, snow, sleet, and the like. Further, the fact that any and/or all components of the flotation device can be made of a soft material such that if the device were to contact anyone or anything while being thrown/cast out, any harm and/or damage would be eliminated and/or minimized. Further, the presently disclosed device is aerodynamic such that it can be throw and/or cast out at great distance and with great accuracy.

From the foregoing, it can be seen that the present invention accomplishes at least all of the stated objectives.

LIST OF REFERENCE CHARACTERS

The following table of reference characters and descriptors are not exhaustive, nor limiting, and include reasonable equivalents. If possible, elements identified by a reference character below and/or those elements which are near ubiquitous within the art can replace or supplement any element identified by another reference character.

TABLE 1

| List of Reference Characters | |
|---|---|
| 100 | flotation device |
| 102 | body |
| 104 | tapered surface |
| 106 | rotatable head |
| 108 | inner, circumferential textured surface of head |
| 110 | central aperture |
| 112 | upper annular surface of head |
| 114 | aligned slot |
| 114A | unaligned slot of head |
| 114B | unaligned slot of body |
| 116 | inner casing |
| 118 | helical ridge |
| 120 | angled channel |
| 122 | finger |
| 124 | lower annular surface of head |
| 126 | upper annular surface of body |
| 200 | flotation device |
| 202 | body |
| 204 | sloped portion |
| 206 | end |
| 208 | handle |
| 210 | slot |
| 212 | outer portion of the slot |
| 214 | inner portion of the slot |

TABLE 1-continued

| List of Reference Characters | |
|---|---|
| 216 | center of the slot |
| 218 | line/rope |
| 220 | water |
| 300 | flotation device |
| 302 | body |
| 304 | sloped portion |
| 306 | end |
| 308 | handle |
| 310 | slot |
| 312 | outer portion of slot |
| 314 | inner portion of slot |
| 316 | center of slot |
| 318 | handle base attachment |
| 400 | flotation device |
| 402 | body |
| 404 | head member |
| 406 | connecting member |
| 408 | slot |
| 408A | body portion of slot |
| 408B | head member portion of slot |
| 408C | connecting member portion of slot |
| 410 | groove of body |
| 412 | receiving connection means |
| 414 | inner receiving portion |
| 416 | outer receiving portion |
| 418 | base of head member |
| 420 | tower |
| 422 | tower protrusion |
| 424 | helical member |
| 426 | surrounding protrusion |
| 428 | connection means |
| 430 | grooves of connecting member |

Glossary

Unless defined otherwise, all technical and scientific terms used above have the same meaning as commonly understood by one of ordinary skill in the art to which embodiments of the present invention pertain.

The terms "a," "an," and "the" include both singular and plural referents.

The term "or" is synonymous with "and/or" and means any one member or combination of members of a particular list.

The terms "invention" or "present invention" are not intended to refer to any single embodiment of the particular invention but encompass all possible embodiments as described in the specification and the claims.

The term "about" as used herein refer to slight variations in numerical quantities with respect to any quantifiable variable. Inadvertent error can occur, for example, through use of typical measuring techniques or equipment or from differences in the manufacture, source, or purity of components.

The term "substantially" refers to a great or significant extent. "Substantially" can thus refer to a plurality, majority, and/or a supermajority of said quantifiable variable, given proper context.

The term "generally" encompasses both "about" and "substantially."

The term "configured" describes structure capable of performing a task or adopting a particular configuration. The term "configured" can be used interchangeably with other similar phrases, such as "constructed", "arranged", "adapted", "manufactured", and the like.

Terms characterizing sequential order, a position, and/or an orientation are not limiting and are only referenced according to the views presented.

The "scope" of the present invention is defined by the appended claims, along with the full scope of equivalents to which such claims are entitled. The scope of the invention is further qualified as including any possible modification to any of the aspects and/or embodiments disclosed herein which would result in other embodiments, combinations, subcombinations, or the like that would be obvious to those skilled in the art.

What is claimed is:

1. A flotation device comprising; a generally cylindrical body comprising a soft material such that damage to external objects is minimized when the flotation device is thrown; a slot that extends through at least a portion of the body from a first end to a second end, wherein the slot comprises: an outer portion; an inner portion; and a center portion; wherein the center portion of the slot is located generally at or near the center of the cylindrical body, the outer portion of the slot is located generally at or near an outer edge of the cylindrical body, and the inner portion of the slot connects the outer and center portions of the slot; and a plurality of handles attached to the cylindrical body via molding, wherein the handles provide flotational stability such that the handles keep the flotation device stable while floating in water or other liquid, and wherein the handles are configured such that a user can throw the flotation device.

2. The flotation device of claim 1, wherein the center portion of the slot is located generally at or near the center of the cylindrical body, the outer portion of the slot is located generally at or near an outer edge of the cylindrical body, and the inner portion of the slot connects the outer and center portions of the slot.

3. The flotation device of claim 1, further comprising a plurality of handles, wherein each of the plurality of handles is configured to fit a hand of a user.

4. The flotation device of claim 3, further comprising a plurality of handle base attachments wherein each handle base attachment is configured to connect an end of each handle to the cylindrical body, wherein the handle base attachments make the flotation device more aerodynamic such that when the flotation device is thrown, the flotation device travels farther and more accurately, and wherein the handle base attachments facilitate improved flotation and/or buoyancy of the flotation device.

5. The flotation device of claim 4, wherein each handle base attachment is at least partially rounded such that each handle base attachment at least partially takes the shape of the cylindrical body.

6. The flotation device of claim 1, wherein the cylindrical body further comprises two ends and two sloped portions, wherein each sloped portion connects one of the two ends to the cylindrical body, and wherein each of the two ends is generally flat.

7. The flotation device of claim 1, wherein the outer portion of the slot comprises two sloped faces that are slanted such that the faces create a wider gap toward an outer edge of the cylindrical body and narrow as the faces extend inward.

8. The flotation device of claim 1, wherein the outer portion is generally shaped as a "V" wherein the point of the "V" points to the center of the cylindrical body.

9. The flotation device of claim 1, wherein the shape of the outer portion is configured to allow a line, rope, or other object to enter the slot via the outer portion.

10. The flotation device of claim 9, wherein the inner portion is operatively connected to the outer portion and the center portion, and wherein the inner portion is configured to facilitate movement of the line, rope, or other object from the outer portion to the center portion.

11. The flotation device of claim 10, wherein the center portion is configured to receive the line, rope, or other object from the inner portion.

12. The flotation device of claim 11, wherein the center portion is configured to secure the line, rope, and/or other object, and wherein when the flotation device is thrown while the line, rope, or other object is secured in the center portion, the line, rope, or other object remains secured in the center portion.

13. The flotation device of claim 12, wherein the center portion is configured to compress and/or apply pressure to the line, rope, and/or other object once the line, rope, or other object is received via the center portion.

14. The flotation device of claim 10, wherein when the line, rope, or other object is received via the center portion, the flotation device is configured to keep the line, rope, or other object floating on top of water or other liquid, and wherein the line, rope, or other object is a boat line or dock line.

15. The flotation device of claim 1, wherein the inner portion of the slot comprises two opposing faces and is generally straight.

16. The flotation device of claim 1, wherein the center portion is generally circular.

17. The flotation device of claim 1, wherein the flotation device is configured such that a user can pull and/or otherwise apply force to a line, rope, or other object to remove the line, rope, or other object from flotation device.

18. The flotation device of claim 1, wherein the flotation device is configured to float in water or other liquid.

19. A method of inserting a line, rope, or other object into a flotation device, the method comprising:

providing a flotation device comprising:

a generally cylindrical body comprising a soft material such that damage to external objects is minimized when the flotation device is thrown;

a slot that extends through at least a portion of the body from a first end to a second end, wherein the slot comprises an outer portion, an inner portion, and a center portion; wherein the center portion of the slot is located generally at or near the center of the cylindrical body, the outer portion of the slot is located generally at or near an outer edge of the cylindrical body, and the inner portion of the slot connects the outer and center portions of the slot; and a plurality of handles attached to the cylindrical body via molding, wherein the handles provide flotational stability such that the handles keep the flotation device stable while floating in water or other liquid, and wherein the handles are configured such that a user can throw the flotation device;

inserting the line, rope, or other object into the outer portion of the slot;

moving the line, rope, or other object from the outer portion toward the center portion of the slot via the inner portion of the slot; and receiving the line, rope, or other object via the center portion.

20. A method of floating a line, rope, or other object on a liquid via a flotation device, the method comprising:

providing a flotation device comprising:

a generally cylindrical body comprising a soft material such that damage to external objects is minimized when the flotation device is thrown;

a slot that extends through at least a portion of the body from a first end to a second end, wherein the slot comprises: an outer portion; an inner portion; and a center portion; wherein the center portion of the slot is located generally at or near the center of the cylindrical body, the outer portion of the slot is located generally at or near an outer edge of the cylindrical body, and the inner portion of the slot connects the outer and center portions of the slot; and a plurality of handles attached to the cylindrical body via molding, wherein the handles provide flotational stability such that the handles keep the flotation device stable while floating in water or other liquid, and wherein the handles are configured such that a user can throw the flotation device;

inserting the line, rope, or other object into the outer portion of the slot;

moving the line, rope, or other object from the outer portion toward the center portion of the slot via the inner portion of the slot;

receiving the line, rope, or other object via the center portion;

securing the line, rope, or other object via the center portion; and placing the flotation device in a liquid.

* * * * *